US007860438B2

(12) United States Patent
Sawai et al.

(10) Patent No.: US 7,860,438 B2
(45) Date of Patent: Dec. 28, 2010

(54) IMAGE FORMING APPARATUS USING TONER INCLUDING AN EXTERNAL ADDITIVE AT AN ADDITIVE BURIAL RATE OF NOT LESS THAN 40 PERCENT

(75) Inventors: Yuuji Sawai, Kanagawa (JP); Shinya Nakayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 879 days.

(21) Appl. No.: 11/748,511

(22) Filed: May 15, 2007

(65) Prior Publication Data

US 2007/0269241 A1 Nov. 22, 2007

(30) Foreign Application Priority Data

May 16, 2006 (JP) ..... 2006-136894

(51) Int. Cl.
*G03G 15/01* (2006.01)

(52) U.S. Cl. ..... 399/299; 399/302

(58) Field of Classification Search ..... 399/299, 399/302, 308

See application file for complete search history.

(56) References Cited

U.S. PATENT DOCUMENTS

| | | | |
|---|---|---|---|
| 5,890,030 | A | 3/1999 | Namekata et al. |
| 6,516,179 | B1 | 2/2003 | Sawai et al. |
| 6,611,672 | B2 | 8/2003 | Aoki et al. |
| 6,618,565 | B2 | 9/2003 | Tamiya et al. |
| 6,697,595 | B2 | 2/2004 | Kawagoe et al. |
| 6,741,821 | B2 | 5/2004 | Sugino et al. |
| 6,768,892 | B2 | 7/2004 | Sawai |
| 6,785,500 | B2 | 8/2004 | Takahashi et al. |
| 6,813,471 | B2 | 11/2004 | Sawai et al. |
| 6,823,149 | B2 | 11/2004 | Yoshikawa et al. |
| 6,850,726 | B1 * | 2/2005 | Mizuno et al. ..... 399/299 |
| 6,901,234 | B2 | 5/2005 | Ogiyama et al. |
| 6,934,484 | B2 | 8/2005 | Suzuki et al. |

(Continued)

FOREIGN PATENT DOCUMENTS

| | | |
|---|---|---|
| EP | 1351100 | 1/2001 |

(Continued)

OTHER PUBLICATIONS

U.S. Appl. No. 12/163,335, filed Jun. 27, 2008, Yoshida.

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

An image forming apparatus includes an image carrier, an endless belt whose front surface contacts the image carrier to form a transfer nip, and a bias applying roller configured to apply a transfer bias to a back surface of the endless belt. An image is formed of a toner having an additive embedded rate of not less than 40 percent and including a mother particle having a binder resin and a colorant, and an external additive. The bias applying roller is located so as to satisfy a relationship, L>(A/2)+(B/2)+C, where A is a diameter of the image carrier, B is a diameter of the bias applying roller, C is a thickness of the endless belt, and L is a distance between centers of the image carrier and the bias applying roller on a virtual plane perpendicular to an axis direction of the image carrier.

9 Claims, 9 Drawing Sheets

U.S. PATENT DOCUMENTS

| | | | | |
|---|---|---|---|---|
| 6,983,121 | B2 | 1/2006 | Sawai | |
| 7,003,238 | B2 | 2/2006 | Yoshida et al. | |
| 7,174,124 | B2 | 2/2007 | Ishibashi et al. | |
| 2003/0096115 | A1* | 5/2003 | Kozaki et al. | |
| 2003/0118359 | A1 | 6/2003 | Ogiyama et al. | |
| 2005/0013636 | A1 | 1/2005 | Sawai et al. | |
| 2006/0056884 | A1 | 3/2006 | Sawai et al. | |
| 2006/0127116 | A1 | 6/2006 | Ogiyama et al. | |
| 2007/0183816 | A1* | 8/2007 | Hatayama et al. | 399/299 |

FOREIGN PATENT DOCUMENTS

| | | |
|---|---|---|
| EP | 1380900 | 1/2004 |
| JP | 03-100661 | 4/1991 |
| JP | 07-028276 | 1/1995 |
| JP | 07-152202 | 6/1995 |
| JP | 09-319134 | 12/1997 |
| JP | 10-083122 | 3/1998 |
| JP | 10-312089 | 11/1998 |
| JP | 11-149179 | 6/1999 |
| JP | 11-184275 | 7/1999 |
| JP | 2001-265135 | 9/2001 |
| JP | 2001-305888 | 11/2001 |
| JP | 2001-331046 | 11/2001 |
| JP | 2002-341615 | 11/2002 |

* cited by examiner

IMAGE FORMING APPARATUS USING TONER INCLUDING AN EXTERNAL ADDITIVE AT AN ADDITIVE BURIAL RATE OF NOT LESS THAN 40 PERCENT

BACKGROUND OF THE INVENTION

1. Field of the Invention

The present invention relates to an image forming apparatus and an image forming method, and more particularly to an image forming apparatus and an image forming method using an intermediate transfer method.

2. Discussion of the Background

An intermediate transfer method is widely used in image forming apparatuses. An example intermediate transfer image forming apparatus includes a photoreceptor, an image forming mechanism, an intermediate transfer belt, an intermediate transfer roller, and a secondary transferer. The intermediate transfer belt is an endless belt that may move in synchronization with the photoreceptor.

After the surface of the photoreceptor is charged, an electrostatic latent image is formed on the photoreceptor. The electrostatic latent image is developed with a toner. The intermediate transfer roller is pressed to the photoreceptor via the intermediate transfer belt to form a transfer nip. The intermediate transfer roller is configured to apply a transfer bias to the transfer nip to transfer the toner images from the photoreceptor onto the intermediate transfer belt. The secondary transferer transfers the image onto a transfer medium.

Recently, the use of low melting toner has been increasing to meet the demand of energy saving and resource saving. Generally, an additive (e.g., inorganic fine particle) is added to the surface of a toner mother particle. However, the additive may be embedded due to mechanical stress, for example when the toner is agitated in a developing unit. The rate of additive being embedded into the mother particle (additive burial rate) is higher in the case of low melting toner. The low melting toner generally has a burial rate of 40 percent or greater.

If the above burial rate is 40 percent or greater, the additive tends to be embedded into the mother particle early and fluidity of the toner may decrease.

When the fluidity is decreased, it is difficult to charge the toner to a predetermined potential by agitating the toner in the developing unit. Further, the toner tends to have an increased agglomerating property. Therefore, the toner may easily agglomerate and have greater mechanical adhesion to the photoreceptor when receiving pressure at the transfer nip. It may become difficult to electrostatically transfer the toner to the intermediate transfer belt and transfer performance of the toner is decreased.

The transfer performance may be enhanced by increasing a transfer bias to increase an electrostatic force. However, when the transfer bias is increased, a potential may be injected into the toner and the toner may be reversely charged. The reversely charged toner may return to the photoreceptor at an exit of the transfer nip.

Further, in a tandem image forming apparatus, in which a toner image on an intermediate transfer belt passes though a plurality of transfer nips, the reversely charged toner may be transferred onto a photoreceptor of a different color (reverse transfer). If such reverse transfer occurs, the toner in a resulting image is partly insufficient.

A technology to lower pressure at an intermediate transfer nip by using an elastic intermediate transfer belt has been proposed. Further, using a brush as a bias applicator in an image forming apparatus has been proposed.

SUMMARY OF THE INVENTION

Various exemplary embodiments disclosed herein describe an image forming apparatus.

In one exemplary embodiment, an image forming apparatus includes an image carrier configured to bear a toner image, an endless belt, and a bias applying roller. A front surface of the endless belt is configured to contact the image carrier to form a transfer nip. The bias applying roller is configured to apply a transfer bias to a back surface of the endless belt to transfer the toner image from the image carrier to the endless belt. The toner image is formed of a toner having an additive embedded rate of not less than 40 percent. The toner includes a mother particle including a binder resin and a colorant, and an external additive. The bias applying roller is located so as to satisfy the following relationship $$L>(A/2)+(B/2)+C$$

where A is a diameter of the image carrier, B is a diameter of the bias applying roller, C is a thickness of the belt, and L is a distance from an axis center of the image carrier to an axis center of the bias applying roller on a virtual plane perpendicular to an axis direction of the image carrier.

In another exemplary embodiment, an image forming method includes applying a transfer bias with a bias applying roller to a back surface of an endless belt to transfer a toner image from an image carrier to the endless belt. A front surface of the endless belt contacts a surface of the image carrier to form a transfer nip. The image forming method also includes forming a toner having an additive embedded rate of not less than 40 percent. The toner includes a mother particle including a binder resin and a colorant, and an external additive. The image forming method also includes locating the bias applying roller so as to satisfy the following relationship $$L>(A/2)+(B/2)+C$$

where A is a diameter of the image carrier, B is a diameter of the bias applying roller, is a thickness of the belt C, and L is a distance from an axis center of the image carrier to an axis center of the bias applying roller on a virtual plane perpendicular to an axis direction of the image carrier.

In another exemplary embodiment, a computer readable storage medium includes computer executable instructions, wherein the instructions, when executed by a processor, cause the processor to perform an image forming method. The image forming method includes applying a transfer bias with a bias applying roller to a back surface of an endless belt to transfer a toner image from an image carrier to the endless belt. A front surface of the endless belt contacts a surface of the image carrier to form a transfer nip. The image forming method also includes forming a toner having an additive embedded rate of not less than 40 percent. The toner image includes a mother particle including a binder resin and a colorant, and an external additive. The image forming method also includes locating the bias applying roller so as to satisfy the following relationship $$L>(A/2)+(B/2)+C$$

where A is a diameter of the image carrier, B is a diameter of the bias applying roller, is a thickness of the belt C, and L is a distance from an axis center of the image carrier to an axis center of the bias applying roller on a virtual plane perpendicular to an axis direction of the image carrier.

BRIEF DESCRIPTION OF THE DRAWINGS

Features and attendant advantages of the invention will be more fully appreciated as the same becomes better understood from the detailed description when considered in connection with the accompanying drawings, wherein.

DETAILED DESCRIPTION OF THE INVENTION

Figure 1:
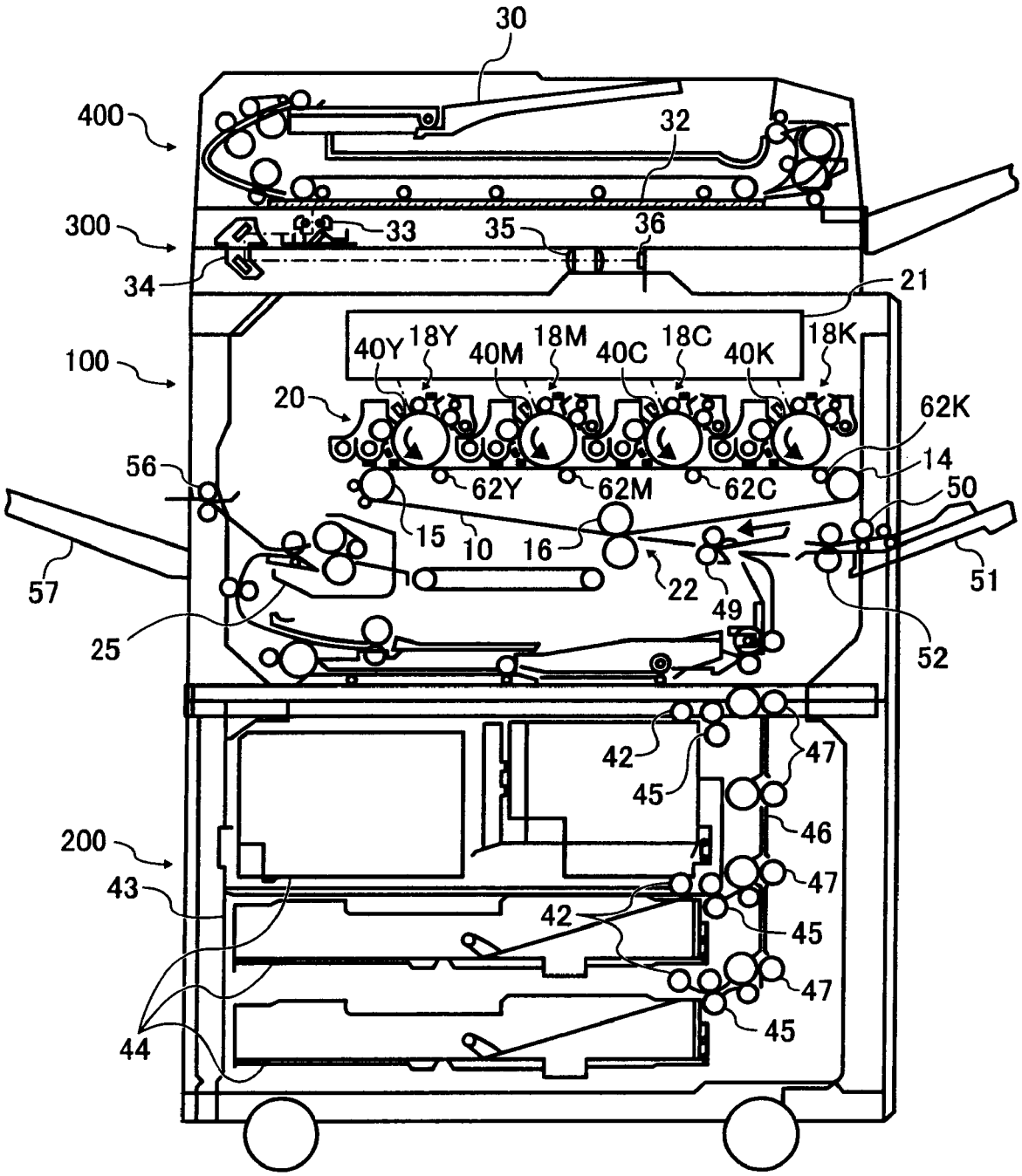
FIG. 1 is an illustration of a tandem image forming apparatus employing an intermediate transfer method according to an exemplary embodiment.

The exemplary embodiments describe an image forming apparatus that will provide better transfer performance when a toner having a better fixing property at lower temperature is used.

Having generally described this invention, further understanding can be obtained by reference to the specific exemplary embodiments that are provided herein for the purpose of illustration only and are not intended to be limiting. It is to be understood that each specific element includes all technical equivalents that operate in a similar manner.

Referring now to the drawings, wherein like reference numerals designate identical or corresponding parts throughout the several views, a tandem type color image forming system according to an exemplary embodiment is described.

Referring to FIG. 1, the image forming system includes an image forming apparatus 100, a sheet feeder 200 storing sheets as transfer mediums, a scanner 300 provided over the image forming apparatus 100, and an automatic document feeder (ADF) 400 provided over the scanner 300. The image forming apparatus may further include a controller (not shown) to control motions of respective parts in the image forming apparatus 100.

The image forming apparatus 100 includes an intermediate transfer belt 10 whose surface endlessly moves, support rollers 14, 15, and 16, a tandem image forming unit 20, an irradiator 21, and intermediate transfer rollers 62Y, 62M, 62C, and 62K. The tandem image forming unit 20 includes four process units 18Y, 18M, 18C, and 18K. The process units 18Y, 18M, 18C, and 18K include photoreceptors 40Y, 40M, 40C, and 40K, that are image carriers, respectively.

The intermediate transfer belt 10 is stretched around the support rollers 14, 15, and 16. A front surface of the intermediate transfer belt 10 contacts surfaces of the respective photoreceptors 40Y, 40M, 40C, and 40K. The process units 18Y, 18M, 18C, and 18K form yellow, magenta, cyan, and black images, respectively, and may be laterally arranged on a front surface of the intermediate transfer belt 10 along its moving direction (belt moving direction) shown as an arrow in FIG. 1. The irradiator 21 may be provided over the process units 18Y, 18M, 18C, and 18K.

The image forming apparatus 100 may further include a secondary transfer roller 22, a fixer 25, a pair of registration rollers 49, a feeding roller 50, a manual feed tray 51, a pair of separation rollers 52, a pair of ejection rollers 56, and an ejection tray 57. The manual feed tray 51 is attached to a side of the image forming apparatus 100. The secondary transfer roller 22 forms a secondary transfer nip with the support roller 16 via the intermediate transfer belt 10.

The sheet feeder 200 includes a plurality of feeding rollers 42, a paper bank 43, a plurality of separation rollers 45, a sheet feeding path 46, and a plurality of conveyance rollers 47. The paper bank 43 includes a plurality of sheet cassettes 44. The sheet feeder 200 may send a sheet as a transfer medium to the image forming apparatus 100.

The scanner 300 includes a contact glass 32, a first carriage 33, a second carriage 34, an imaging lens 35, and a reading sensor 36. The first carriage 33 includes a light source. The second carriage 34 includes a mirror. The ADF 400 includes a document table 30 and may automatically forward the original document placed on the document table 30 to the contact glass 32.

The scanner 300 may read image information from an original document placed on the contact glass 32 with the reading sensor 36 and send the image information to the controller. The controller receives the image information and controls respective parts in the image forming apparatus 100 to form a toner image.

Processes to read an original document by the scanner 300 for copying are described below. A user places an original document on the document table 30. Alternatively, the user opens the ADF 400 and places the original document on the contact glass 32 of the scanner 300.

When the user pushes a start button (not shown), the original document on the document table 30 is forwarded onto the contact glass 32. Alternatively, the scanner 300 is immediately driven to read the image information of the original document, when the original document is placed on the contact glass 32.

The scanner 300 starts to run the first carriage 33. The light source of the first carriage 33 emits light to the original document. The light is reflected by a surface of the original document. The reflected light is sent to the second carriage 34. In this time, the second carriage 34 starts to run similarly. The mirror in the second carriage 34 further reflects the light to forward the light to the reading sensor 36 through the imaging lens 35. Thus, the reading sensor 36 reads image information on the original document.

The controller receives the image information from the scanner 300 and instructs a laser irradiator, LED, etc., included in the irradiator 21 to irradiate each of the photoreceptors 40Y, 40M, 40C, and 40K. With the irradiation, electrostatic latent images are formed on the surfaces of the photoreceptors 40Y, 40M, 40C, and 40K. The process units 18Y, 18M, 18C, and 18K develop the electrostatic latent images into toner images. Each of the intermediate transfer rollers 62K, 62Y, 62M, and 62C is a bias applying roller and applies a transfer bias to the back surface of the intermediate transfer belt 10 to transfer the toner image from one of the photoreceptors 40Y, 40M, 40C, and 40K onto the intermediate transfer belt 10. The toner images are superimposed one on another on the intermediate transfer belt 10.

Processes to transport a sheet from the sheet feeder 200 to the image forming apparatus 100 are described below. In the sheet feeder 200, one of the feeding rollers 42 rotates to send a sheet from a corresponding sheet cassette 44. A pair of separation rollers 45 corresponding to the feeding roller 42 separates and sends the sheets one by one to a transport path 46 when the feeding roller 42 sends a plurality of sheets in a pile. The conveyance rollers 47 forward the sheet to the next conveyance rollers 47.

Alternatively, the user may use the manual feed tray 51. The feeding roller 50 rotates to send out a sheet from the manual feed tray 51. The pair of separation rollers 52 separates the sheets to send the sheets one by one.

In the image forming apparatus 100, the pair of registration rollers 49 may stop the sheet by sandwiching a leading edge of the sheet therebetween. The pair of registration rollers 49 may timely forward the sheet to the secondary transfer nip so that the sheet may be lapped over the superposed image on the intermediate transfer belt 10. While the sheet passes through the secondary transfer nip, the superimposed image is transferred onto the sheet.

The sheet is forwarded from the secondary transfer nip to the fixer 25 that may fix the image on the sheet with heat and pressure. After the fixing process, the pair of ejection rollers 56 ejects the sheet onto the ejection tray 57.

Although the registration rollers 49 are generally grounded, a bias may be applied to the registration rollers 49 to remove paper dust and debris from the surface of the sheet.

Figure 2:
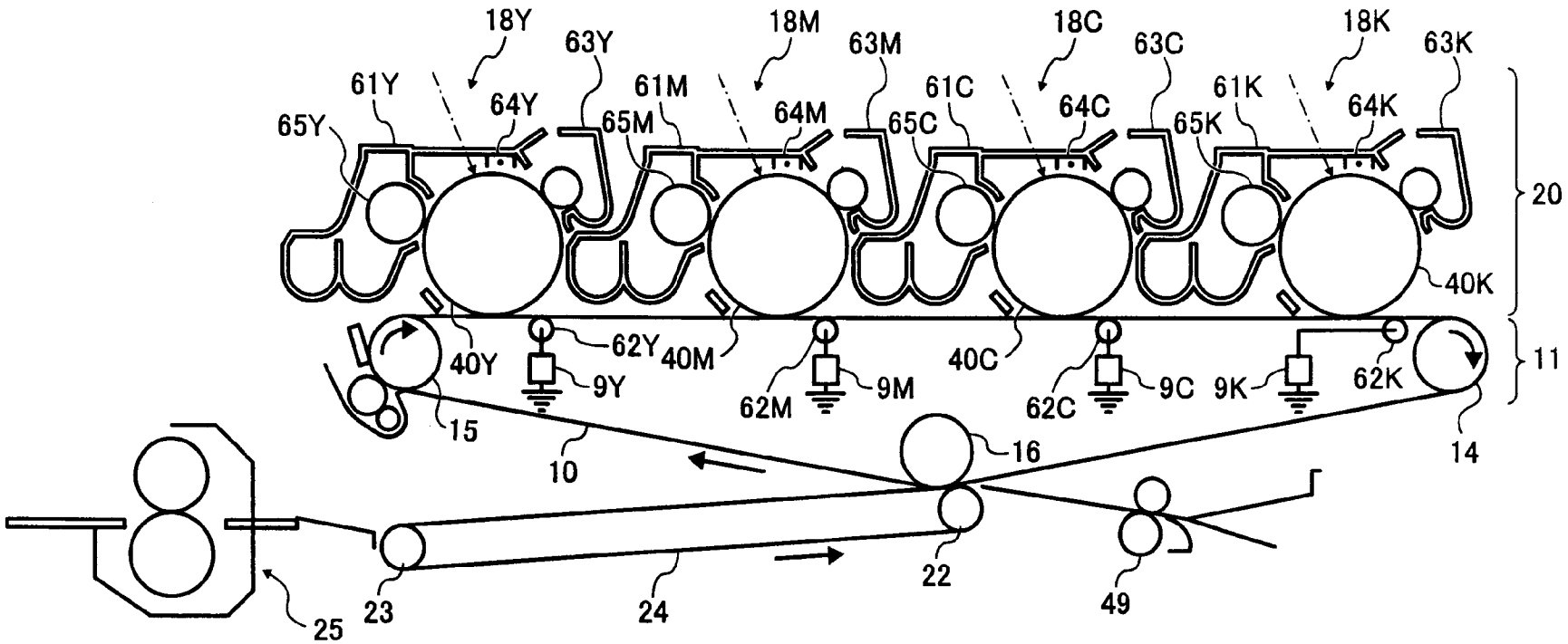
FIG. 2 is an enlarged illustration of a main part of the image forming apparatus of FIG. 1.

FIG. 2 illustrates a configuration around the tandem image forming unit 20 in more detail. The intermediate transfer rollers 62Y, 62M, 62C, and 62K are provided with power sources 9Y, 9M, 9C, and 9K, respectively. The image forming apparatus 100 further includes a roller 23 and a transport belt 24 in a secondary transfer region. The components enclosed in the intermediate transfer belt 10 constitute a transfer unit 11 in an exemplary embodiment. The process units 18Y, 18M, 18C, and 18K include developing units 61Y, 61M, 61C, and 61K, respectively.

The four process units 18Y, 18M, 18C, and 18K have a similar configuration, except for using different color toners. Here, the process unit 18Y is explained and explanation of the process units 18M, 18C, and 18K are omitted. Likewise, only the intermediate transfer roller 62Y is explained because the intermediate transfer rollers 62Y, 62M, 62C, and 62K have a similar configuration. The image forming unit 18Y includes a charger 64Y a developing unit 61Y, and a photoreceptor cleaner 63Y, around the photoreceptor 40Y. A driving member (not shown) may drive the photoreceptor 40Y to rotate counterclockwise in FIG. 2. Along with the rotation of the photoreceptor 40Y, the charger 64*y* uniformly charges the surface of the photoreceptor 40Y to a non-image potential V. The developing unit 61*y* includes a developing sleeve 65Y.

Next, the irradiator 21 illustrated in FIG. 1 applies laser light to an area of the surface of the photoreceptor 40Y, corresponding to the image information. Now, the area to which the laser light is applied has an image potential $V_L$, and an electrostatic latent image is formed therein. The developing unit 61Y includes a toner. The developing unit 61Y transfers the toner through the developing sleeve 65*y* to the photoreceptor 40Y, to develop the electrostatic latent image into a yellow toner image.

The power source 9Y applies a bias to the intermediate transfer roller 62Y. As a result, transfer electric field is formed at the intermediate transfer nip to transfer the yellow toner image onto the intermediate transfer belt 10.

Next, the photoreceptor cleaner 63Y cleans the surface of the photoreceptor 40Y. The process unit 18Y may further include a discharger to remove electricity from the surface of the photoreceptor 40Y after the cleaning as a preparation for a next image formation. The process units 18M, 18C, and 18K perform similar processes to form magenta, cyan, and black toner images, respectively.

The intermediate transfer belt 10 may be endlessly rotated clockwise in FIG. 2 when a driving member (not shown) drives one of the support rollers 14, 15, and 16 to rotate. The intermediate transfer roller 62Y may be placed downstream of the photoreceptor 40Y in the belt moving direction. The intermediate transfer roller 62Y may press the intermediate transfer belt 10 to the photoreceptor 40Y. By being pressed, the intermediate transfer belt 10 may partially wind around the photoreceptor 40Y at positions upstream of the intermediate transfer roller 62Y in the belt moving direction, to form intermediate transfer nips.

The power source 9Y applies a bias to the intermediate transfer roller 62Y to form an intermediate transfer electric field. The yellow image on the photoreceptor 40Y is transferred onto the intermediate transfer belt 10 with the effect of the intermediate transfer electric field and nip pressure in an intermediate transfer process. Similarly, the magenta, cyan, and black images on the photoreceptor 40M, 40C, and 40K are transferred and superimposed one on another on the yellow image. Thus, a four-color image is formed on the intermediate transfer belt 10.

The transport belt 24 may be stretched around the secondary transfer roller 22 and the roller 23. A driving member (not shown) may rotate the transport belt 24 counterclockwise in FIG. 2. The secondary transfer roller 22 is in contact with the support roller 16 via the intermediate transfer belt 10 and the transport belt 24. The secondary transfer nip is formed between the intermediate transfer belt 10 and the transport belt 24. A power source may supply a secondary transfer bias to the secondary transfer roller 22 to form the secondary transfer electric field.

At the secondary transfer nip, the four-color image on the intermediate transfer belt 10 is transferred onto the sheet with the effects of the secondary transfer electric field and nip pressure in a secondary transfer process. Because the sheet is white-colored, the four-color image becomes a full color image on the sheet. After the full color image is recorded on the sheet, the transport belt 24 transports the sheet to the fixer 25.

The toner used in the image forming apparatus 100 has a better fixing property at lower temperatures. The toner includes a mother particle and at least one additive externally added to the surface of the mother particle. The additive may be embedded into the mother particle while the toner is agitated in the developing unit. An additive burial rate of the toner, which is the rate of additive embedded into the mother particle, is 40 percent or greater. The additive burial rate is higher in the case of such a low melting toner.

Figure 3:
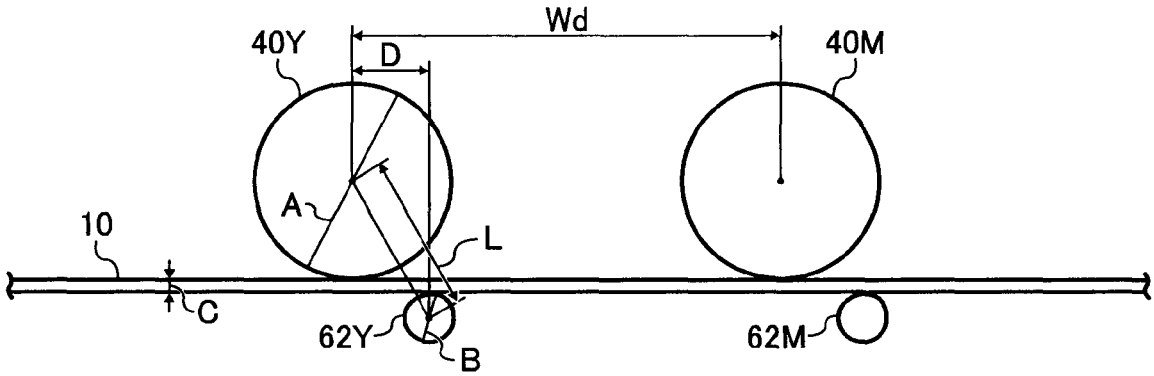
FIG. 3 is an illustration to explain a positional relationship between a photoreceptor and an intermediate transfer belt.

Referring to FIG. 3, a positional relationship between the photoreceptors 40Y, 40M, 40C, and 40K and the intermediate transfer rollers 62Y, 62M, 62C, and 62K is described. As illustrated in FIG. 3, the intermediate transfer roller 62Y is preferably placed at a position not facing the photoreceptor 40Y because the image forming apparatus 100 uses the toner having a better fixing property at lower temperature.

Accordingly, the toner has an increased agglomerating property. Therefore, the nip pressure is excessively high for such a toner when the intermediate transfer roller 62Y faces the photoreceptor 40Y via the intermediate transfer belt 10 to form the intermediate transfer nip. In this case, transfer performance is insufficient because of toner agglomeration.

In FIG. 3, the photoreceptor 40Y has a diameter A and the intermediate transfer roller 62Y has a diameter B. The intermediate transfer belt 10 has a thickness C. The distance between the centers of the photoreceptor 40Y and the intermediate transfer roller 62Y is shown as a distance L. The distance between the centers of photoreceptors 40Y, 40C, 40M, and 40K is Wd. The distance between the centers of the photoreceptor 40Y and the intermediate transfer roller 62Y in the belt moving direction is shown as distance D. The intermediate transfer roller 62Y may be placed on a plane perpendicular to an axis direction of the intermediate transfer belt 10 along a vertical plane so that the distance L satisfy the following formula 2, $$L>(A/2)+(B/2)+C.$$

When the above relation is satisfied, the intermediate transfer roller 62Y is placed at a position not contacting the photoreceptor 40Y via the intermediate transfer belt 10. With this configuration, the intermediate transfer nips are formed where the intermediate transfer belt 10 winds around the photoreceptors 40Y, 40C, 40M, and 40K. The nip pressure at the above intermediate transfer nips is smaller compared with the nip pressure when each of the photoreceptors 40Y, 40C, 40M, and 40K, and each of the intermediate transfer roller 62Y, 62C, 62M, and 62K, face each other via the intermediate transfer belt 10. Therefore, a satisfactory transfer property may be available even if the toner has an additive burial rate of 40 percent or greater and easily agglomerates.

Hereinafter an intermediate transfer roller 62 refers to any one of the intermediate transfer rollers 62Y, 62M, 62C, and 62K hereinafter, and a photoreceptor 40 refers to any one of the photoreceptors 40Y, 40M, 40C, and 40K.

The transfer current flows from the intermediate transfer roller 62 through the intermediate transfer belt 10, which is a resistor, and flows to the photoreceptor 40 at the intermediate transfer nip. The resistivity varies with the distance between the intermediate transfer roller 62 and the photoreceptor 40, and accordingly the amount of current varies. As the distance increases, the required voltage increases for a required transfer current. Therefore, when the distance between the intermediate transfer roller 62 and the photoreceptor 40 is excessively large, the required voltage becomes high and a power source may run out of capacity.

Further, when the voltage increases, an electric field at a space between the intermediate transfer belt 10 and the photoreceptor 40 becomes stronger and an image failure due to a discharge phenomenon is likely to occur. Further, when the distance between the intermediate transfer roller 62 and the photoreceptor 40 is excessively large, the distance between the intermediate transfer roller 62 and the downstream intermediate transfer roller 62 is insufficient. Therefore, a leak current, which is the transfer current leaking from the intermediate transfer roller 62 and flowing to the downstream transfer nip, may increase. Because of the leak current, it becomes difficult to obtain an optimum transfer condition at the intermediate transfer nips for magenta, cyan, and black toners. This results in a transfer failure.

Therefore, in an exemplary embodiment, the distance D between the centers of the photoreceptor 40Y and the intermediate transfer roller 62 and the distance Wd between the photoreceptors satisfies the following formula 3, $$D<Wd/10.$$

When the above relation is satisfied, the voltage to obtain the required transfer electric field does not excessively increase and the discharge phenomenon at the space between the intermediate transfer belt 10 and the photoreceptor 40 may be reduced or prevented. Further, by setting the distance D between the photoreceptor 40 and the intermediate transfer roller 62 under one tenth of the distance Wd, the leak current may be reduced and the transfer failure due to the leak current may be reduced or prevented.

Figure 4:
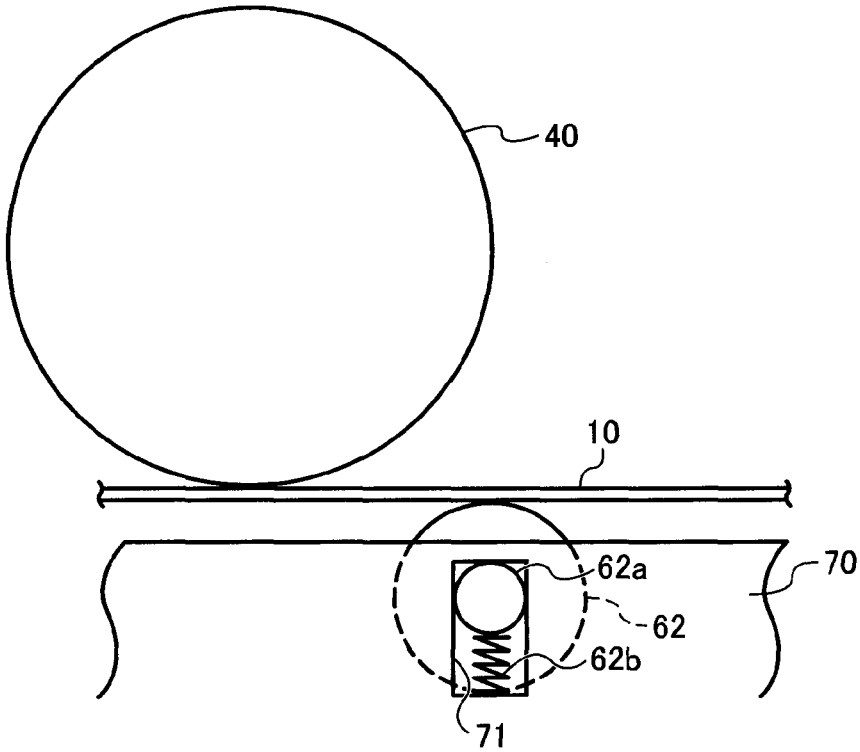
FIG. 4 is an illustration of a holder of the intermediate transfer roller.

Referring to FIG. 4, a holder of the intermediate transfer roller 62 is described. The intermediate transfer belt 10 is housed in a frame 70. The holder may serve as a positioner for positioning the intermediate transfer roller 62. The holder includes a long hole 71 provided on the frame 70. The long hole 71 is provided with a bearing 62*a* and a spring 62*b*. The bearing 62*a* may move up and down in contact with the long hole 71 and rotatably hold the intermediate transfer roller 62. The spring 62*b* may push the bearing 62*a* toward the photoreceptor 40. The bearing 62*a* contacts an upper surface of the long hole 71 by the force of the spring 62*b*, and the position of the intermediate transfer roller 62 is determined.

As described above, the position of the intermediate transfer roller 62 is determined by the long hole 71 and the force of the spring 62*b*. Therefore, fluctuation of the width of the transfer nip and the nip pressure may be better controlled compared with the case where a spring presses the intermediate transfer roller 62 to the intermediate transfer belt 10 and the position of the intermediate transfer roller 62 is not determined.

Next, the intermediate transfer belt 10 is described in detail. The intermediate transfer belt 10 may be either a single-layered belt or a multi-layered belt. The intermediate transfer belt 10 may be manufactured through a dipping method, a centrifugal molding method, an extrusion molding method, an inflation method, a coating method, etc., and is not limited to a specific manufacturing method.

The intermediate transfer belt 10 may include a polyimide resin, a polyamide-imide resin, a polycarbonate resin, a polyphenylene sulfide resin, a polyurethane resin, a polybutylene terephthalate resin, a polyvinylidene-fluoride resin, a polysulfone resin, a polyether-sulfone resin, a polymethylpentene resins as its material. The above materials may be used singly or in combination.

Polyimide resins and polyamide-imide resins are preferable from the viewpoint of strength. Electrical resistance of the intermediate transfer belt 10 may be controlled by adding conductive carbon black, etc.

The intermediate transfer belt 10 has a surface resistivity within a range from 9.5 log Ω/square to 12 log Ω/square. The rate of current flowing along the surface depends on the surface resistivity of the intermediate transfer belt 10. Therefore, the voltages at the intermediate transfer nips have different decreasing slopes according to the surface resistivity of the intermediate transfer belt 10.

When the surface resistivity is under 9.5 log Ω/square, the difference between the voltage applied to the intermediate transfer roller 62 and the voltage at the intermediate transfer nip is small. In this case, it is not necessary to apply a high voltage to the intermediate transfer roller 62. However, the intermediate transfer belt 10 has a high potential at a transfer nip entrance, which is located at an upstream end of the intermediate transfer nip. As a result, the electric field at the space between the intermediate transfer belt 10 and the photoreceptor 40 becomes stronger at the transfer nip entrance. The strong electric field may cause a part of the toner image on the photoreceptor 40 to be scattered beyond the space, and causes toner scattering on a resulting image, particularly on characters.

To the contrary, when the surface resistivity is over 12 log Ω/square, a higher voltage is required for the intermediate transfer roller 62 to obtain satisfactory transfer performance. Therefore, the power sources 9Y, 9M, 9C, and 9K may run out of capacity. Further, the intermediate transfer belt 10 has a high potential at a transfer nip exit, which is located at a downstream end of the intermediate transfer nip. As a result, an abnormal disparage is likely to occur at the space between the intermediate transfer belt 10 and the photoreceptor 40 at the transfer nip exit.

The intermediate transfer belt 10 is discharged by being in contact with the conductive support roller while rotating, not by a dedicated discharger to remove electricity. This is a common discharge method for an intermediate transfer belt in an image forming apparatus.

Discharge speed of the intermediate transfer belt 10 by the conductive support roller varies according to its surface resistivity. The time constant of potential decay becomes larger when the surface resistivity is high and becomes smaller when the surface resistivity is small.

Figure 5:
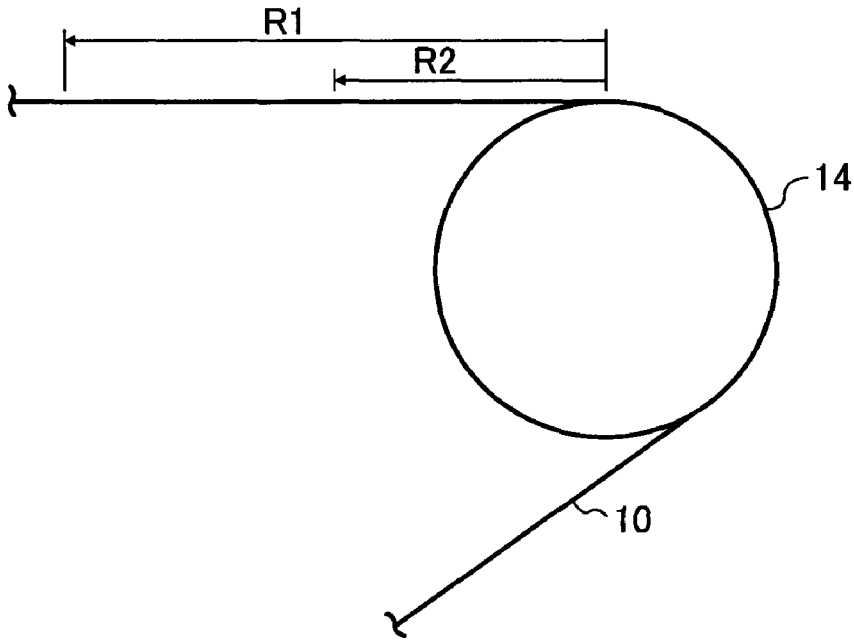
FIG. 5 illustrates that a discharge region by a conductive support roller differs depending on a surface resistivity of an intermediate transfer belt.

FIG. 5 illustrates a relationship between the surface resistivity of the intermediate transfer belt 10 and a discharge area by the conductive support roller 14. The intermediate transfer belt 10 is discharged in a region R1 when the surface resistivity is low and in a region R2 when the surface resistivity is high. Although only the start points of the regions R1 and R2 are shown by arrow-heads and the end points thereof are not shown in FIG. 5, the regions R1 and R2 may extend symmetrically.

As illustrated in FIG. 5, an electric charge flows from a portion of the intermediate transfer belt 10 that is not in contact with the support roller 14 to the support roller 14. When the surface resistivity is low, the electric charge flows more easily from the portion of the intermediate transfer belt 10 that is far from the support roller 14. That is, when the intermediate transfer belt 10 has a lower resistivity, the discharge speed is faster because its discharge region is larger. To the contrary, when the intermediate transfer belt 10 has a higher resistivity, the electric charge does not flow as easily and the discharge region is smaller compared to when the intermediate transfer belt 10 has a lower resistivity. Therefore, the discharge speed is slower and an amount of remaining charge increases. When the amount of remaining charge increases, the discharge phenomenon is likely to occur between the intermediate transfer belt 10 and an adjacent member while the intermediate transfer belt 10 rotates. The discharge phenomenon is likely to occur when the surface resistivity is over 12.0 log Ω/square.

In an exemplary embodiment, satisfactory image quality with reduced image failures such as toner scattering may be obtained because the intermediate transfer belt 10 has a surface resistivity within a range from 9.5 log Ω/square to 12.0 log Ω/square. Further, a high intermediate transfer bias is not necessary and accordingly the power sources 9Y, 9M, 9C, and 9K do not need a large capacity. Further, the discharge phenomenon between the intermediate transfer belt 10 and an adjacent member may be reduced.

The surface resistivity of the intermediate transfer belt 10 increases due to energization. The increase in the surface resistivity is referred to as an amount of surface resistivity change. In an exemplary embodiment, a surface resistivity tolerance of the intermediate transfer belt 10 at the stage of manufacturing is within a range from 9.5 log Ω/square to 11.5 log Ω/square. If the surface resistivity of the intermediate transfer belt 10 increases half a digit or greater due to energization, the surface resistivity exceeds the 12.0 log Ω/square and the discharge phenomenon is likely to occur.

Therefore, the amount of surface resistivity change of the intermediate transfer belt 10 is set to 0.5 log Ω/square or less during a period from 10 seconds to 5 hours after the start of continuous energization of 500 V.

A possible way to control the failure due to the increase in surface resistivity is to narrow the tolerance of the surface resistivity to enlarge a safety margin for the increase due to energization. However, a more strict manufacturing control is necessary to narrow the tolerance. This may increase the cost of the intermediate transfer belt 10.

When a voltage of 500 V is continuously applied for five hours, the intermediate transfer belt 10 comes into a state similar to a state at its replacement time that is after the image forming apparatus 100 outputs 200,000 to 300,000 sheets. Therefore, the failure due to an increase in surface resistivity may be prevented till the replacement time of the intermediate transfer belt 10 if the change amount after five hours is 0.5 log Ω/square or less.

Figure 6:
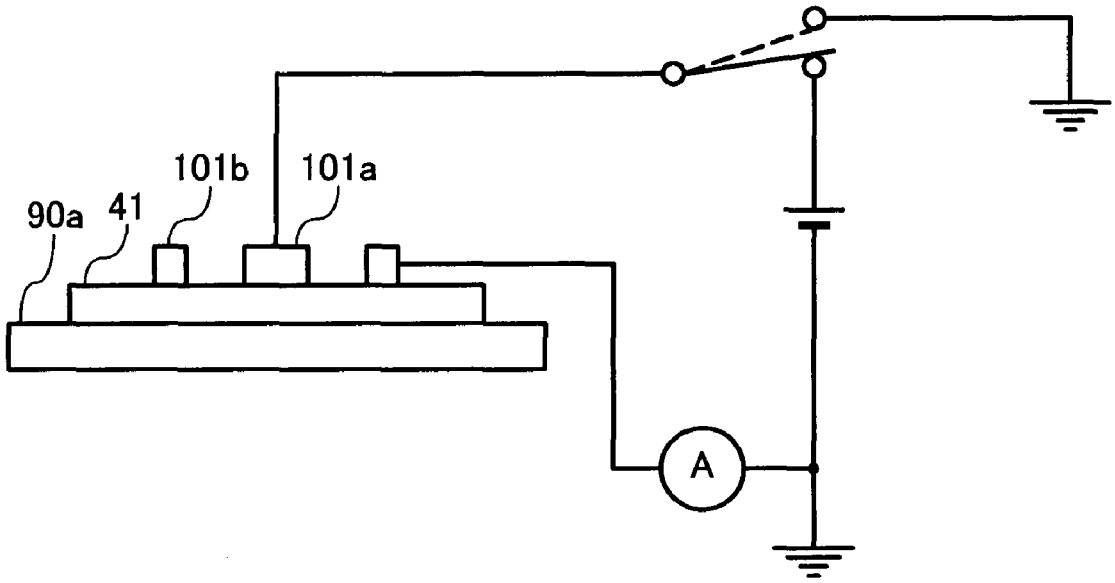
FIG. 6 is a schematic illustration of a measuring unit for measuring surface resistivity.

Next, a method to measure the surface resistivity of the intermediate transfer belt 10 is described, referring to FIG. 6. The surface resistivity of a sample 41, which is produced using a similar material under a similar condition to the material and the condition of the intermediate transfer belt 10, was measured by using a measurement unit illustrated in FIG. 6. The measurement unit includes an insulating plate 90*a*, an ammeter, a power source, and an electrode probe having an inner electrode 101*a* and a ring electrode 101*b*.

The ring electrode 101*b* is placed at a certain distance from the inner electrode 101*a*. The sample 41 is placed on the insulating plate 90*a* so that a surface of the sample 41 corresponding to the front surface of the intermediate transfer belt 10 (surface contacting the photoreceptor 40) contacts the plate 90*a*. The inner electrode 101*a* and the ring electrode 101*b* are placed on the sample 41. The electric current flowing through the ring electrode 101*b* was measured with the ammeter under the condition that the power source applied a voltage of 500 V to the inner electrode 101*a* with a load of 2 kg.

The value calculated based on the measurement value after 10 seconds of the above voltage application is regarded as the surface resistivity of the sample 41. Further, surface resistivity of the sample 41 after 5 hours of the above voltage application was calculated. The amount of surface resistivity change was calculated by deducting the surface resistivity after 10 seconds from the surface resistivity after 5 hours.

For the above probe, a URS probe with a conductive rubber, Hiresta UP Model MCP-HT45OURS manufactured by Mitsubishi Chemical Corp., was used. A constant voltage power source was used to apply voltage to the inner electrode 101*a*. The values on the ammeter were checked with eyes and by outputting the measurement data to a computer. A continuous measurement may be performed with a timer turned off. The resistivity measurement may be performed by using the above probe and by externally controlling a constant voltage power source, an ammeter, etc., by a computer.

Figure 7:
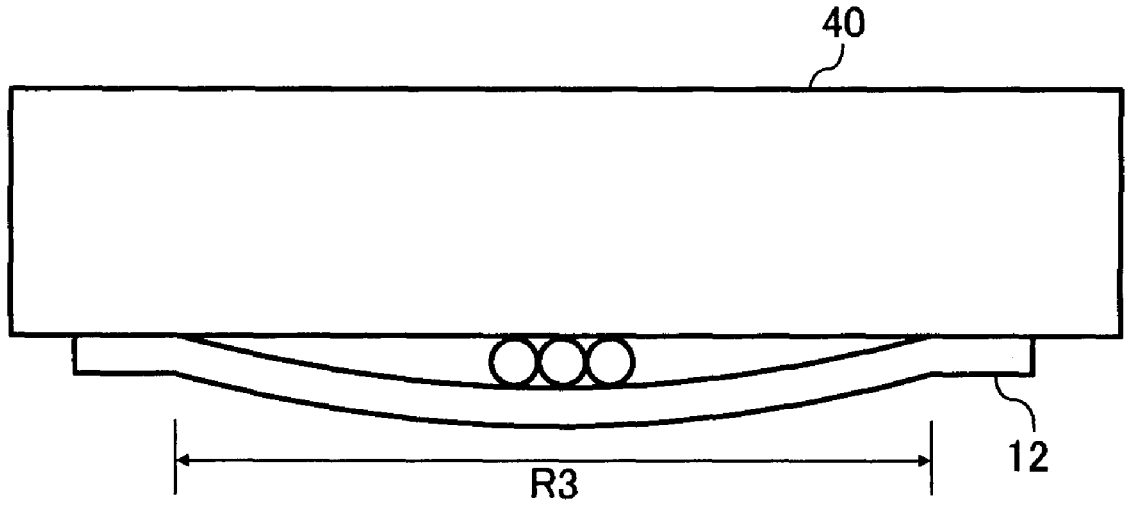
FIG. 7 illustrates a toner image transferred onto a thick intermediate transfer belt.
Figure 8:
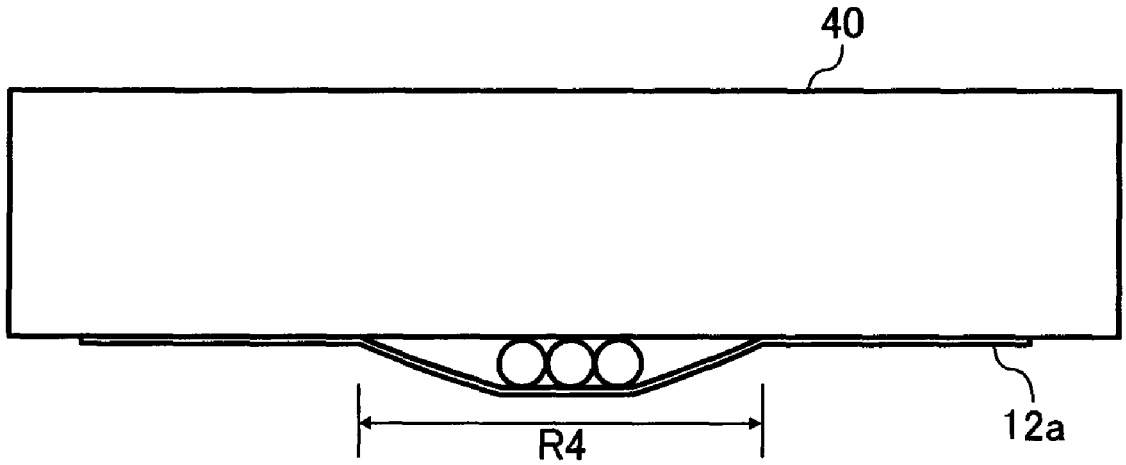
FIG. 8 illustrates a toner image transferred onto a thin intermediate transfer belt.

Next, the thickness of the intermediate transfer belt 10 is described. FIG. 7 illustrates a part of an intermediate transfer belt 12 around a toner image. The intermediate transfer belt 12 is thicker. FIG. 8 illustrates apart of an intermediate transfer belt 12*a* around a toner image. The intermediate transfer belt 12*a* is thinner.

As illustrated in FIGS. 7 and 8, the intermediate transfer belts 12 and 12*a* are curved around the toner images at the intermediate transfer nips and have non-contact regions R3 and R4 that are not in contact with the photoreceptors 40, respectively. The non-contact region R3 of the thicker intermediate transfer belt 12 is larger than the non-contact region R4 of the thinner intermediate transfer belt 12*a*. This is because an intermediate transfer belt increases in rigidity and becomes hard to deform as the intermediate transfer belt becomes thicker.

As illustrated in FIG. 7, if the intermediate transfer belt 12 has the larger non-contact region R3, the toner image receives a higher nip pressure and the toner agglomerates. As a result, transfer performance is impaired. Particularly, the toner has a higher agglomerating property if the toner has an additive burial rate of 40 percent or more. Therefore, the thicker intermediate transfer belt 12 is not preferable because the nip pressure increases. A possible way to reduce the nip pressure to the toner image is to reduce the hardness degree of the intermediate transfer roller 62 and to deform the intermediate transfer roller 62 by a thickness of the toner image. However, the effect is not enough.

To the contrary, because the intermediate transfer belt 12*a* in FIG. 8 has the smaller non-contact region R4, the nip pressure to the toner image is lower. Therefore, the transfer performance is not impaired. However, the thinner intermediate transfer belt 12*a* is more stretchy. Accordingly, displacement of color is likely to occur due to the expansion of the intermediate transfer belt 12*a*. As a countermeasure to the expansion, a material having a rigidity of 3000 Mpa or greater (e.g., polyimide, polyamide-imide, etc.) is used for the intermediate transfer belt. Particularly, the effect is high when the intermediate transfer belt is thin.

In an exemplary embodiment, a single-layered belt including polyimide or polyamide-imide is used as the intermediate transfer belt 10. However, when the above intermediate transfer belt 10 has a thickness under 40 μm, the intermediate transfer belt 10 is likely to be stretched. Because displacement of color is likely to occur, the thickness is not preferable.

Further, when the above intermediate transfer belt 10 has a thickness over 100 μm, the non-contact region with the photoreceptor 40 becomes larger. Therefore, the nip pressure to the toner image increases and the transfer performance is impaired.

A polyimide resin is described below as a preferable material for the intermediate transfer belt 10. Because the polyimide resin has a higher strength, the intermediate transfer belt may be thinned by using a polyimide resin.

Polyimide is generally produced through condensation reaction of an aromatic diamine and an aromatic polyhydric carboxylic anhydride or a derivative thereof. However, polyimide is non-soluble because of its strong principal chain structure. Therefore, firstly a polyimide precursor that is soluble in an organic solvent is synthesized from an acid anhydride and an aromatic diamine. Examples of the polyimide precursor are poly(amic acid) and a polyamic acid. At this stage, molding processing is performed through various methods. Polyimide is obtained by cyclodehydrating or imidizing the polyimide precursor with heat or through a chemical method.

Examples of aromatic polyhydric carbolic anhydride are ethylene tetracarboxylic acid dianhydride, cyclopentene tetracarboxylic acid dianhydride, pyromellitic dianhydride, 3,3',4,4'-benzophenone tetracarboxylic acid dianhydride, and 3,3',4,4',-biphenyl tetracarboxylic acid dianhydride. One or a mixture including two or more of the above chemicals may be used.

Examples of aromatic diamine are m-phenylenediamine, o-phenylenediamine, p-phenylenediamine, m-aminobenzylamine, p-aminobenzylamine, 4,4'-diaminodiphenylether, 3,3'-diaminodiphenylether, and 3,4'-diaminodiphenylether. One or a mixture including two or more of the above chemicals may be used. The materials for producing polyimide are not limited to the above examples.

The above aromatic polyhydric carboxylic anhydride and the aromatic diamine are polymerized in a substantially equimolar organic polar solvent, to obtain a polyimide precursor (e.g., polyamic acid). Any organic polar solvent may be used in the polymerization as long as the organic polar solvent dissolves the polyamic acid. Preferable organic polar solvent is N,N-dimethyl acetamide and N-methyl-2-pyrrolidone.

Although polyamic acids are easily produced, a polyimide vanish that is commercially available as a polyamic acid dissolved in an organic solvent may be used. Examples of polyimide vanish are Torayneece manufactured by Toray Industries Inc., U-Varnish manufactured by UBE INDUCTRIES LTD., Rika-coat manufactured by New Japan Chemical Co., Ltd., Optomer manufactured by JSR Corporation, SE812 manufactured by NISSAN CHEMICAL INDUSTRIES, LTD., and CRC8000 manufactured by SUMITOMO BAKELITE CO., LTD.

An electron conductive or ion conductive resistance regulator may be added to polyimide to adjust its electric resistance. The electron conductive resistance regulator may be metal powder or metal oxide powder. Examples of metal powder are carbon black, graphite, copper, tin, aluminum, and indium. Examples of metal oxide powder are tin oxide, zinc oxide, titanic oxide, indium oxide, antimony oxide, bismuth oxide, antimony-doped tin oxide, and tin-doped indium oxide.

Examples of ion conductive resistance regulators are tetraalkylammonium salt, trialkylbenzil, ammonium salt, alkyl sulfonate, alkyl benzene sulfonate, alkyl sulfate, glycerin fatty acid ester, sorbitan fatty acid ester, polyoxyethylene alkylamine, polyoxyethylene fatty alcohol ester, alkylbetaine, and lithium perchlorate. The resistance regulator is not limited to the above chemical compounds.

Among the above, carbon black is preferable for polyimide. The polyamic acid obtained in the above method is heated to a range from 200° C. to 350° C., and converted into polyimide. Thus, a polyimide resin is obtained.

The amount of surface resistivity increase of the intermediate transfer belt 10 by continuous energization varies depending on dispersion state of conductive agent. The surface resistivity increase may be reduced by enhancing the dispersiveness of conductive agent.

Next, the toner to be used in an exemplary embodiment is described. The toner includes a mother particle having a binder resin and a colorant. At least one inorganic fine particle is externally added to the surface of the mother particle. The toner has the additive burial rate of 40 percent or more after the additive is embedded through the following method. By using the above toner, the image forming apparatus 100 may have better fixing property at lower temperature.

The embedding of additive was performed using a polyethylene ointment bottle whose capacity is within a range from 300 ml to 500 ml. In the bottle, 10 grams of toner and 100 grams of resin-coated ferritic carrier were mixed with a tubular mixer for 30 minutes at a speed of 100 rpm. Through the above process, the embedding of the additive to the toner mother particle saturates and is settled.

Known materials may be used as the resin-coated ferritic carrier. The ferritic carrier used in an exemplary embodiment was EF963-60B that is coated with a silicone resin and manufactured by Powder-Tech Co. Ltd., and has a particle size within a range from 35 μm to 85 μm. Wab tubular mixer T2F manufacture by Willy A Bachofen AG was used as the tubular mixer. Next, 300 ml of water is added in the ointment bottle. The mixture in the ointment bottle was slightly agitated to separate the toner and the carrier in the water. The toner dispersion liquid, the supernatant solution in the ointment bottle, was filtered. The filtered toner was dried under a reduced pressure at room temperature. Thus, the toner to which the additive was embedded was obtained.

A specific surface area of the toner by the BET method (by Brunauer, Emmett, and Teller) was measured before and after the embedding of additive by using TriStar3000, an automatic analyzer for specific surface area and fine pores distribution, manufactured by SHIMADZU CORPORATION. One gram of toner was put into a specially designed cell. The cell was deaerated by Vacprep 061, a degassing device manufactured by SHIMADZU CORPORATION dedicated for a TriStar, for 20 hours under a reduced pressure of 100 mTorr or less at room temperature. With the specially designed cell, the BET specific surface area may be automatically obtained by TriStar 3000. Nitrogen gas was used as an absorption gas.

Figure 9:
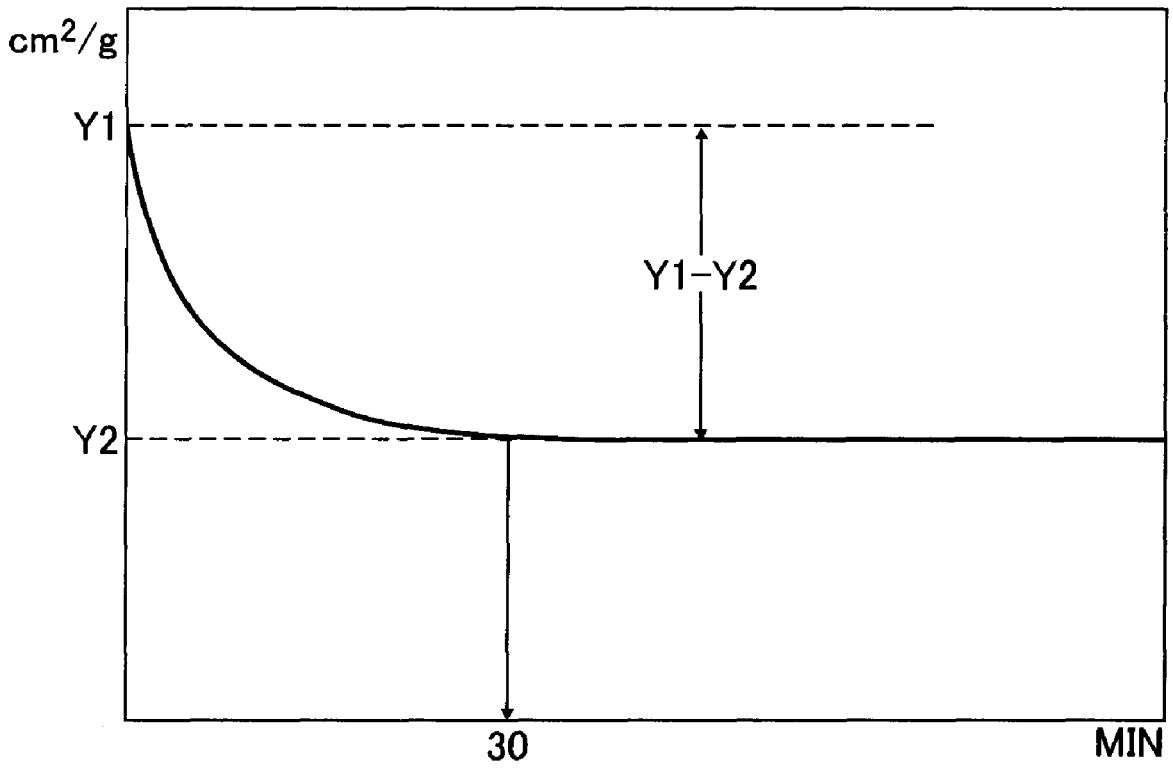
FIG. 9 illustrates a relation between toner agitation time and toner specific surface area.

FIG. 9 illustrates a relation between the BET specific surface area and the agitation time of toner with carrier in the polyethylene ointment bottle. In FIG. 9, the vertical axis shows the BET specific surface area and the horizontal axis shows the agitation time. After the toner is agitated for the time required for embedding of additive to saturate, the embedding of the additive is settled and the toner maintains a substantially constant BET specific surface area. The burial rate X of the inorganic fine particle is calculated after the toner is agitated under the above conditions until the embedding of additive saturates (for 30 minutes), by using the following formula 1, $$X(\%)=\{(Y1-Y2)/Y1\}\times 100$$

where Y1 is the BET specific surface area in $cm^2/g$ before the embedding of additive and Y2 is the BET specific surface area in $cm^2/g$ after the embedding of additive.

As long as the above conditions are satisfied, any toner produced through a known method may be used. As the binder resin and the colorant, known materials may be used.

Examples of binder resin are a polyester resin, a styrene resin, an acrylic resin, a styrene-acrylic resin, a polyol resin, and an epoxy resin. The polyester resin is preferable from the viewpoint of a fixing property at a lower temperature. The binder resin having a glass transition point (Tg) within a range from 40° C. to 75° C. is used. Preferably, the Tg is within a range from 45° C. to 65° C. When the Tg is excessively low, the toner has poor heat resistance stability. When the Tg is excessively high, the toner has a poor fixing property at a lower temperature.

The glass transition point may be measured by a differential scanning calorimeter (DSC). In an exemplary embodiment, the glass transition point was obtained based on a glass transition point curve measured with DSC-60A manufactured by SHIMADZU CORPORATION, with a temperature increase rate of 10° C. per minute.

As the colorant, known dyes and pigments may be used. Examples of colorant are carbon black, naphthol yellow, Hansa yellow, permanent red, oil red, quinacridone red, phthalocyanine blue, and anthraquinone blue. The colorant is not limited to the above examples.

The toner may further include are leasing agent. A known releasing agent, for example, polyethylene wax, polypropylene wax, paraffin wax, etc., may be used. Further, the toner may include a charge adjuster, as required. A known charge adjuster, for example, a nigrosine dye, a triphenyl methane dye, etc., may be used. The amount of charge adjuster depends on the toner manufacturing conditions including type of binder resin, additives, and the method of dispersion.

The inorganic fine particle is added to the toner to enhance its flow characteristic, developing characteristic, and charge characteristic. The inorganic fine particle preferably has an average primary particle size within a range from 5 nm to 2 μm. The ratio of inorganic fine particle to toner particle, which depends on type thereof, is often within a range from 0.01 weight percent to 5 weight percent. Examples of inorganic fine particle are silica, alumina, titanium oxide, barium titanate, and magnesium titanate. The above inorganic fine particles may be used singly or in combination.

A toner including a polyester resin as its binder is manufactured through an ester extension polymerization method. The ester extension polymerization method is described below. Firstly, an organic solvent phase including a polyester prepolymer is dispersed in an aqueous medium phase with an active hydrogen-containing compound. After an extension reaction and/or a cross-linking reaction occurs in the aqueous medium, the organic solvent is removed and toner particles are obtained. The toner particles are washed and dried into toner particle powder. This method excels in granulation performance and easily controls particle size, particle size distribution, and shape.

The materials used in the ester extension polymerization method are described below. The polyester prepolymer forms a toner binder (binder resin) having a higher molecular weight through the extension reaction and/or cross-linking reaction with the active hydrogen-containing compound in the aqueous medium. Examples of polyester prepolymer include polyester prepolymers having a functional group that reacts to an active hydrogen (reactive polyester prepolymer). A polyester prepolymer having an isocyanate group as the active hydrogen is preferable.

The polyester prepolymer is produced by reacting polyisocyanate (PIC) with a polyester that is a polycondensation product of polyol (PO) and polycarboxylic acid (PC) and includes an active hydrogen group. Examples of the above polycondensation product are bisphenol A alkylene oxide adduct, dicarboxylic acids (e.g., succinic acid, adipic acid, maleic acid, fumaric acid, phthalic acid, and terephthalic acid), and polycarboxylic acids having more than three function groups (e.g., trimellitic acid and pyromellitic acid).

Examples of polyisocyanate (PIC) are aliphatic polyisocyanates, alicyclic polyisocyanates, aromatic diisocyanates, aromatic aliphatic diisocyanates (e.g., α,α,α',α'-tetramethylxylylene diisocyanate), isocyanurate, and a product produced by blocking the polyisocyanate with a phenol derivative, oxime, caprolactam, etc.

Examples of aliphatic polyisocyanate are tetramethylene diisocyanate, hexamethylenediisocyanate, and 2,6-diisocyanate methylcaproate. Examples of alicyclic polyisocyanates are isophorone diisocyanate and cyclohexylmethane diisocyanate. Examples of aromatic diisocyanates are tolylene diisocyanate and diphenylmethane diisocyanate. The above materials may be used singly or in combination.

The polyester prepolymer having isocyanate group generally includes more than one isocyanate group per molecule. The polyester prepolymer preferably has an average of 1.5 to 3 isocyanate groups per molecule, and more preferably has an average of 1.8 to 2.5 isocyanate groups per molecule. If the amount of isocyanate group is less than one per molecule, the molecular weight of polyester after extension reaction is not high enough. As a result, the toner has poor resistance to hot offset. The hot offset is a phenomenon wherein overheated toner adheres to a heating roller during a fixing process and causes an image defect.

The polyester prepolymer is dissolved in the organic solvent phase as described above. The polyester prepolymer content in toner mother particle is within a range from 10 weight percent to 55 weight percent. The polyester prepolymer content is preferably 10 weight percent to 40 weight percent, and more preferably 15 weight percent to 30 weight percent.

Further, a non-reactive polyester may be used in combination with the above reactive polyester prepolymer, and may be dissolved in the organic solvent phase in combination with the reactive polyester prepolymer. The combined use is preferred to the single used of the reactive polyester prepolymer. The reason is that the fixing property at lower temperature and gloss in full color image of toner are enhanced.

Examples of non-reactive polyester are a polycondensation product of polyol (PO) and polycarboxylic acid (PC), etc., similarly to the reactive polyester prepolymer that is used in the reaction with polyisocyanate (PIC). Preferable examples are the same as the example above. When the non-reactive polyester is included in the organic solvent phase in combination with the reactive polyester prepolymer, the weight ratio of the non-reactive polyester to the reactive polyester prepolymer is from 10:90 to 55:45. The above weight ratio is preferably from 10:90 to 40:60, and more preferably from 15:85 to 30:70.

If the weight ratio of the reactive polyester prepolymer is excessively low, the resistance to hot offset is impaired and it becomes difficult to balance the heat resistant stability and the fixing property at a low temperature. Instead of non-reactive polyester, the toner may further include another known binder resin (e.g., styrene resin, acrylic resin, epoxy resin, styrene-acrylic acid ester copolymer, etc).

As the active hydrogen compound, amines are preferable. A urea modified polyester resin is produced by the reaction of an amine with the isocyanate group in the polyester prepolymer. Examples of amines are diamine, a polyamine having three or more amino groups, amino alcohol, amino mercaptan, amino acids, and materials obtained by blocking the amino groups of the above amines. Preferred examples are 4,4'-diamino diphenylmethane, isoholon diamine, hexamethylene diamine, ethanolamine, aminoethyl mercaptan, aminopropionic acid, and a ketimine compound obtained by blocking amino groups of the above with a ketone (e.g., methylethyl ketone).

The colorant or colorant master batch is preferably dissolved or dispersed in the organic solvent phase preliminary together with the reactive polyester prepolymer and the non-reactive polyester. Further, the release agent and/or the charge adjuster may be dissolved or dispersed in the organic solvent phase, as required.

The aqueous medium phase can include water. Further, an organic solvent may be used in combination with water. It is preferable to use an organic solvent to which the resinous principle of the organic solvent phase is dissolvable, to lower viscosity of the aqueous medium when the resinous principle is dispersed into the aqueous medium. The organic solvent preferably has a boiling point less than 100° C. to be easily distilled away.

Examples of the above organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These organic solvents can be used alone or in combination.

Further, it is preferable to disperse a particulate resin in the aqueous medium. The particulate resin is used for controlling the shape of toner (e.g., roundness, particle size distribution, etc.), and unevenly adheres on the surface of the toner particle. Any resin that forms a dispersion element in the aqueous medium can be used as the particulate resin.

The resin can be thermoplastic or thermoset. Examples of the resin include vinyl resins, polyurethane resins, epoxy resins, polyester resins, polyamide resins, polyimide resins, silicone resins, phenol resins, melamine resins, urea resins, aniline resins, ionomer resins, and polycarbonate resins. These can be used alone or in combination. To easily make water dispersion of the particulate resin, vinyl resins, polyurethane resins, epoxy resins, polyester resins, and combinations thereof are preferably used.

Specific examples of the vinyl resins include, but are not limited to, homopolymers and copolymers of vinyl monomers such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers.

The dispersion ratio of the particulate resin in the aqueous medium is preferably within a range from 0.5 weight percent to 10 weight percent with respect to the organic solvent phase. If the ratio is out of the above range, emulsification is hindered and granulation may not be obtained. The more preferable range is from 1 weight percent to 3 weight percent. A mean particle size of the particulate resin is within a range from 5 nm to 200 nm from the viewpoint of granulation. The mean particle size is preferably within a range from 20 nm to 300 nm. The particulate resin preferably has a glass transition point within a range from 40° C. to 90° C., from the viewpoint of fixing property at low temperature and storage stability. The glass transition point is more preferably within a range from 50° C. to 70° C.

The organic solvent phase and the amine dispersion can be stably formed in the aqueous medium, through a known dispersion method using shearing force, etc. Examples of the dispersion method include, but are not limited to, a low-speed shearing method, a high-speed shearing method, a friction method, a high-pressure jet method, and an ultrasonic method.

A disperser may be used as required to stably form the organic solvent phase and the amine dispersion in the aqueous medium. Examples of disperser include anionic surfactants such as alkylbenzene sulfonic acid salts, α-olefin sulfonic acid salts and phosphoric acid salts; cationic surfactants of quaternary ammonium salts type such as alkyltrimethyl ammonium salts, dialkyldimethyl ammonium salts, alkyldimethyl benzyl ammonium salts; nonionic surfactants such as fatty acid amide derivatives, polyhydric alcohol derivatives; and ampholytic surfactants such as alanine, dodecyldi(aminoethyl)glycin, and di(octylaminoethyl)glycine.

To remove the organic solvent from the dispersion liquid, it is preferable to gradually raise the temperature of the entire system and to completely evaporate the organic solvent.

The image forming apparatus 100 according to an exemplary embodiment uses the two-component developer produced by mixing the above toner and the magnetic carrier. The content of toner in the developer is preferably within a range from 1 part by weight to 10 parts by weight, per 100 parts by weight of the carrier. The content of toner is more preferably within a range from 5 parts by weight to 10 parts by weight.

The magnetic carrier may be a known material such as iron powders, ferrite powders, magnetite powders, and magnetic resin carriers. The magnetic carrier may be coated with a resin such as amino resins (e.g., urea-formaldehyde resins, melamine resins, benzoguanamine resins, urea resins, polyamide resins, epoxy resins), polyvinyl resins, and polyvinylidene resins. Examples of polyvinyl resins and polyvinylidene resins are acrylic resins, polymethyl methacrylate resins, polyacrylonitrile resins, polyvinyl acetate resins, polyvinyl alcoholic resins, polyvinyl butyral resins, polystyrene resins, and polystyrene resins (e.g., styrene-acryl copolymer). Further, examples of the coating resin include halogenoid olefin resins (e.g., polyvinyl chloride), polyester resins (e.g., polyethylene terephthalate resins, polybutylene terephthalate resins), polycarbonate resins, polyethylene resins, polyvinyl fluoride resins, polyvinylidene fluoride resins, polytrifluoro ethylene resins, polyhexafluoro propylene resins, copolymers of vinylden fluoride and acryl monomer, copolymers of vinylden fluoride and vinyl fluoride, fluoroterpolymers (e.g., terpolymers of tetrafluoroethylene, vinylden fluoride, and non-fluorinated monomer), and silicone resins.

The coating resin can include a conductive powder, etc., as required. Examples of conductive powder are metal powders, carbon black, titanium oxide, tin oxide, and zinc oxide. The conductive powder preferably has a mean particle size less than 1 μm. When the conductive powder has a mean particle size over 1 μm, control of electric resistance is difficult.

Next, examples and comparative examples according to exemplary embodiments are described.

Firstly, examples of the intermediate transfer belt used in the examples and comparative examples are described.

Intermediate Transfer Belt 10*a*

Polymerization of 3,3',4,4'-biphenyl tetracarboxylic acid dianhydride as the aromatic polyhydric carboxylic anhydride, p-phenylenediamine as the aromatic diamine, and N-methyl-2-pyrrolidone as the organic polar solvent was performed to obtain a polyamic acid solution. Acetylene black was added to the polyamic acid solution, to the amount of 17% to the solid content density thereof.

The mixture is agitated with Aquamizer manufactured by Hosokawa Micron Corporation. Thus, polyamic acid having 18 percent of solid content as precursor of polyimide resin was prepared.

The polyamic acid obtained as above was molded into a ring through a centrifugal molding method while a metal cylindrical mold having a diameter of 250 mm was rotated at a speed of 100 rpm, and polyamic acid having a solid content of 18% was uniformly applied to an inner surface of the cylindrical mold by a dispenser. Next, the cylindrical mold was rotated at a speed of 1000 rpm for 5 minutes to level the polyamic acid. Next, the rotation speed was reduced to 300 rpm, and the cylindrical mold was gradually heated to 130° C. The polyamic acid was dried for 40 minutes and was solidified. After the solidification, the cylindrical mold was stopped to rotate and heated to 350° C., to cause imide ring-closing. Thus, imidization was completed and polyimide coating was obtained.

Next, the cylindrical mold was cooled to room temperature and the polyimide coating was removed therefrom. Both edges of the polyamic coating were cut off so that the polyamic coating had a width of 250 mm. From the above, a seamless intermediate transfer belt 10*a* was produced. The intermediate transfer belt 10*a* was adjusted to have a layer thickness of 82 μm, a surface resistivity of 10.4 log Ω/square, and an elasticity of 4200 Mpa.

The layer thickness is adjustable by controlling the amount of polyamic acid applied by the dispenser. The surface resistivity is adjustable by adjusting the amount of a conductive agent, etc. To adjust the elasticity, another polyamic acid solution using 4,4'-diaminodiphenylether, which is different from the aromatic diamine used to produce the above polyamic acid solution, was mixed with the above polyamic acid solution. The elasticity is adjustable to control the mixing ratio of the polyamic acid solution using 4,4'-diaminodiphenylether and the polyamic acid solution using p-phenylenediamine.

Intermediate Transfer Belts 10*b* to 10*i*

By changing the amount of conductive agent from the intermediate transfer belt 10*a*, intermediate transfer belts 10*b* to 10*i* were produced. The intermediate transfer belts 10*b* to 10*i* were adjusted to have an elasticity of 4200 Mpa. The intermediate transfer belts, except for the intermediate transfer belt 10*e*, had a surface resistivity change amount of 0.2 log Ω/square in a continuous measurement from 10 seconds to 5 hours after the start of the voltage application. The dispersion condition of the intermediate transfer belt 10*e* was lower than other intermediate transfer belts, and the intermediate transfer belt 10*e* had a surface resistivity change amount of 0.5 log Ω/square in a continuous measurement from 10 seconds to 5 hours after the start of the voltage application.

Intermediate Transfer Belts 10*j* to 10*p*

Intermediate transfer belts 10*j* to 10*p* having different layer thickness were produced by changing the amount of polyamic acid applied to the cylindrical mold by the dispenser. The intermediate transfer belts 10*j* to 10*p* had a surface resistivity of 11.1 log Ω/square, an elasticity of 4200 Mpa, and a surface resistivity change amount of 0.2 log Ω/square in a continuous measurement from 10 seconds to 5 hours after the start of the voltage application. The elasticity was based on JIS-K7113.

Next, toners A to E used in examples and comparative examples are described.

Toner A

A milky liquid was prepared by mixing 950 parts of water, 20 parts of a vinyl resin (copolymer of sodium salt of styrene-methacrylic acid-butyl acrylate-methacrylic acid ethylene oxide adduct sulfate ester) water dispersion (by Sanyo Chemical Industries Ltd.), 16 parts of a 48.5% solution of a sodium salt of dodecyl diphenyl ether disulfonic acid (ELEMINOL MON-7 from Sanyo Chemical Industries Ltd.), 12 parts of 3.0% solution of a polymer protective colloid, carboxymethylcellulose, (CELLOGEN BSH from Sanyo Chemical Industries Ltd.), and 130 parts of ethyl acetate. This milky liquid was used as a water phase.

A mixture of 1200 parts of water, 50 parts of carbon black (REGAL 400R from Cabot Corporation), 50 parts of a polyester resin (RS801 having a weight-average molecular weight of 19,000 and a Tg of 64° C., from Sanyo Chemical Industries Ltd.), and 30 parts of water was agitated with HENSCHEL MIXER manufactured by Mitsui Mining Co, Ltd. The mixture was kneaded for 30 minutes at 150° C. with a two-roll mill and extended and cooled. The mixture was further pulverized by a pulverizer. Thus, a carbon black master batch was obtained.

In a reaction vessel equipped with a stirrer and a thermometer, 500 parts of a polyester resin (RS801 having a weight-average molecular weight of 19,000 and Tg of 64° C., from Sanyo Chemical Industries Ltd.), 30 parts of carnauba wax, and 850 parts of ethyl acetate were agitated at 80° C. The reaction vessel was kept at 80° C. for 5 hours, and then cooled to 30° C. over 1 hour. The was dispersed by using a bead mill (ULTRAVISCOMILL from Aimex Co., Ltd.), under the conditions of a liquid feeding speed of 1.2 kg per hour, a disc peripheral speed of 8 meters per second, dispersion media of zirconia beads with a diameter of 0.5 mm, a beads filling factor of 80% by volume, and dispersion repeat of 3 times.

Next, 110 parts of the above carbon black master batch and 500 parts of ethyl acetate were mixed in the reacting vessel for 1 hour to obtain a dissolved material. Further, 240 parts of ethyl acetate was added to the reaction vessel and the mixture was dispersed with the above bead mill under the conditions of a liquid feeding speed of 1.2 kg per hour, a disc peripheral speed of 8 meters per second, dispersion media of zirconia beads with a diameter of 0.5 mm, a beads filling factor of 80% by volume, and dispersion repeat of 3 times. The resulting dispersion liquid was used as an oil phase.

Next, 1,780 parts of the above oil phase, 100 parts of a 50% ethyl acetate solution of a polyester prepolymer (having a number average molecular weight of 3,800, a weight-average molecular weight of 15,000, and a Tg of 60° C., from Sano Chemical Industries Co., Ltd.), 15 parts of isobutyl alcohol, and 7.5 parts of isoholon diamine were mixed in the reaction vessel. The mixture was agitated for 1 minute at a rotation speed of 6,000 rpm with TK HOMOMIXER (manufactured by Tokushu Kika Kogyo K.K). Further, 1200 parts of wafer phase was added to the reaction vessel and then the mixture was agitated for 20 minutes at a rotation speed of 7,500 rpm with TK HOMOMIXER, to obtain an aqueous medium dispersion liquid.

The above aqueous medium dispersion liquid was kept at a temperature of 30° C. for 12 hours in a reaction vessel equipped with a stirrer and a thermometer, to remove the organic solvent, and then aged for 8 hours at a temperature of 45° C. Thus, a dispersion liquid without organic solvents was obtained. Under a reduced pressure, 100 parts of the dispersion liquid was filtered to obtain a wet cake. The wet cake was mixed with 500 parts of ion-exchange water with TK HOMOMIXER for 10 minutes at a rotation speed of 12,000 rpm. The mixture was further filtered under a reduced pressure. The wet cake was dried for 48 hours at a temperature of 45° C. with a circulating air drier, and then sieved with a screen having openings of 75 μm. Thus, a mother toner particle was prepared.

The toner A was prepared by mixing 100 parts of the above toner mother particles, 1.2 parts of a hydrophobic silica having an average primary particle size of about 12 nm as an external additive (from Clariant Japan Co. Ltd.), 0.5 part of a hydrophobic titanium oxide having an average primary particle size of about 12 nm (from TAYCA CAORPORATION), and 0.8 part of a hydrophobic silica having an average primary particle size of about 120 nm (from Shin-Etsu Chemical Co., Ltd.) with HENSCHEL MIXER. The mixture was filtered with a screen having an opening of 38 μm to remove agglomerate materials. The toner A had a weight-average particle size (D4) of 5.8 μm, a number-average particle size (Dn) of 5.1 μm, a mean roundness of 0.97, and an additive burial ratio X of 42%.

Toner B

The toner B was prepared through the procedure for preparing the toner A. However, 500 parts of a polyester resin having a number-average molecular weight of 9,800, a weight-average molecular weight of 33,000, and a Tg of 68° C. (from Sanyo Chemical Industries Co., Ltd.) was used instead of 500 parts of RS801 having a weight-average molecular weight of 19,000 and Tg of 64° C. (from Sanyo Chemical Industries Co., Ltd). The toner B had a weight-average particle size (D4) of 5.9 μm, a number-average particle size (Dn) of 5.2 μm, a mean roundness of 0.97, and an additive burial ratio of 30%.

Toner C

The toner C was prepared through the procedure for preparing the toner A. However, 500 parts of a polyester resin having a number-average molecular weight of 2,500, a weight-average molecular weight of 6,700, and a Tg of 44° C. (from Sanyo Chemical Industries Co., Ltd.) was used, instead of 500 parts of RS801 (from Sanyo Chemical Industries Co., Ltd). The toner B had a weight-average particle size (D4) of 5.8 μm, a number-average particle size (Dn) of 5.1 μm, a mean roundness of 0.97, and an additive burial ratio of 70%.

Toner D

The toner D was prepared through the procedure for preparing the toner A. However, 500 parts of a polyester resin having a weight-average molecular weight of 12,000 and Tg of 56° C. (from Sanyo Chemical Industries Co., Ltd.) was used, instead of 500 parts of RS801 (from Sanyo Chemical Industries Co., Ltd). The toner B had a weight-average particle size (D4) of 5.7 μm, a number-average particle size (Dn) of 5.1 μm, a mean roundness of 0.98, and an additive burial ratio of 56%.

Toner E

The toner E was prepared through the procedure for preparing the toner A. However, 500 parts of a polyester resin having a weight-average molecular weight of 27,000 and Tg of 66° C. (from Sanyo Chemical Industries Co., Ltd.) was used, instead of 500 parts of RS801 (from Sanyo Chemical Industries Co., Ltd). The toner B had a weight-average particle size (D4) of 5.7 μm, a number-average particle size (Dn) of 5.1 μm, a mean roundness of 0.98, and an additive burial ratio of 38%.

The weight-average particle size (D4) and number-average particle size (Dn) were measured by using COULETR MULTISIZER II manufactured by Coulter Electrons Inc. The number of particles to be counted was set to 50,000. The measurement method is described below.

As a dispersant, 0.1 to 5 ml of a surfactant is added to 100 ml to 150 ml of an electrolyte. A preferable surfactant is alkylbenzene sulfonate. Here, as the electrolyte, a 1% NaCl aqueous solution including a first grade sodium chloride such as ISOTON-II (from Coulter Electrons Inc.) is used. Further, 2 mg to 20 mg of toner particles to be measured is added to the electrolyte and dispersed by an ultrasonic dispersing machine for about 1 minute to 3 minutes to prepare a toner suspension liquid. The volume and the number of toner particles are measured by the above instrument using an aperture of 100 μm to determine the distribution thereof. The weight average particle size (D4) and the number average particle diameter (Dn) are available based on the distribution.

The mean roundness was measured by using a flow-type particle image analyzer, FPIA-2100 (manufactured by Sysmex Corp.), and analyzing software, FPIA-2100 Data processing Program for FPIA version 00-10. The method is described below. Firstly, 0.1 ml to 0.5 ml of a 10 weight percent solution of a surfactant (alkylbenzene sulfonate NEOGEN SC-A from Dai-ichi Kogyo Seiyaku Co., Ltd.) was put in a 100 ml glass beaker. Further, 0.1 g to 0.5 g of toner was added, the mixture was agitated with a micro spatula, and further 80 ml of ion-exchange water was added to the beaker. The mixture was dispersed using an ultrasonic dispersing machine (manufactured by Honda Electronics) for 3 minutes. A resulting dispersion liquid was analyzed with FPIA-2100 for the shape and distribution of the toner particles. The analysis was continued until a dispersion liquid having a density within a range from 5,000 to 15,000 particles per μl was obtained. It is important to set the density in the above range, by changing dispersion conditions (e.g., amounts of surfactant and toner), for a better roundness measurement.

The amount of surfactant varies depending on the hydrophobic property of toner, similarly to the toner particle size measurement. When the amount of surfactant is excessive, noise is generated due to foam. When the amount is insufficient, toner is not wet enough and dispersion is not sufficient.

The amount of toner varies depending on its particle size. The amount is reduced when the particle size is smaller, and is increased when the particle size is larger. When the toner has a particle size within a range from 3 μm to 7 μm, the density of the dispersion liquid can be set in a range from 5,000 to 15,000 particles per μl, by adding 0.1 g to 0.5 g of the toner.

Figure 10A:
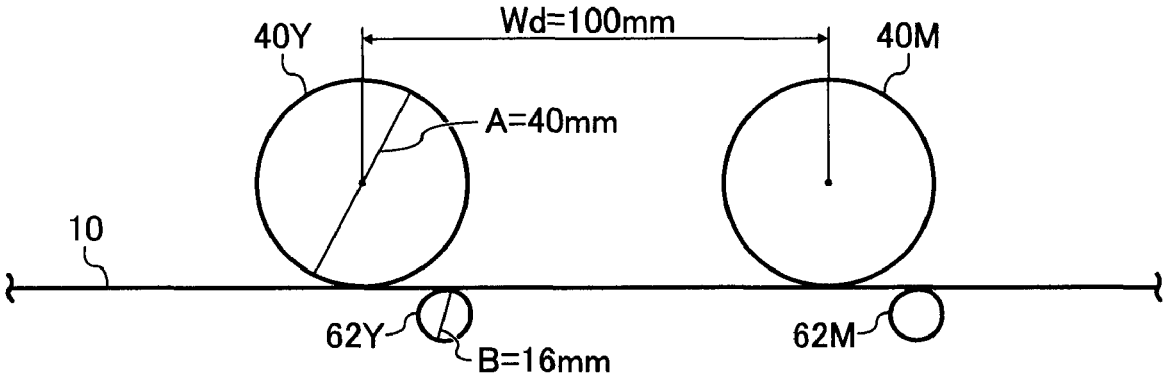
FIGS. 10A and 10B illustrate an exemplary positional relationship between a photoreceptor and an intermediate transfer belt of an image forming apparatus.
Figure 10B:
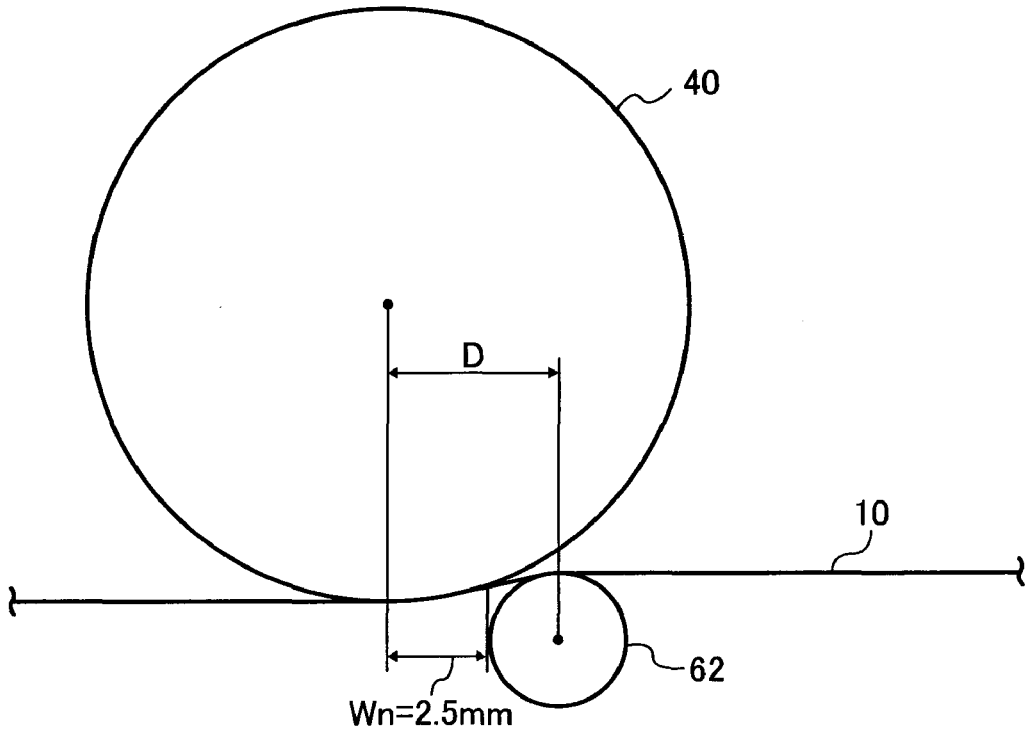

Next, the image forming apparatus 100 used in the examples 1 to 14 and comparative examples 1 to 11 is explained. FIGS. 10A and 10B are for explaining a positional relationship between the photoreceptor 40 and the intermediate transfer roller 62.

The photoreceptor had a diameter (A) of 40 mm. The intermediate transfer roller 62 had a diameter (B) of 16 mm. The distance between the centers of photoreceptors 40 (Wd) was 100 mm.

As illustrated in FIG. 10B, a distance between the centers of the photoreceptor 40 and the intermediate transfer roller 62 in a belt moving direction is determined as distance D. A width Wn of the intermediate transfer nip was measured as follows. Firstly, a uniform toner image was formed on the intermediate transfer belt 10. The image forming apparatus 100 was turned off before the toner image was transferred onto a sheet. Next, the transfer unit 11 (FIG. 2) was detached from the image forming apparatus 100. The intermediate transfer belt 10 was manually moved so that the toner image was at a position corresponding to a portion of the photoreceptor 40 at which the intermediate transfer nip was measured. A driving gear, etc., were removed to prevent the intermediate transfer belt 10 from rotating. After an electrode, etc., were removed not to apply voltage to the intermediate transfer rollers 62, the transfer unit 11 was attached to the image forming apparatus 100.

Next, the image forming apparatus 100 was powered on so that the photoreceptor 40 was rubbed with the intermediate transfer belt 10 that is in a halting state. Thus, a scraping mark was formed on the toner image. The photoreceptor 40 may be manually rotated from outside. The transfer unit 11 was detached from the image forming apparatus 100. The width Wn of the intermediate transfer nip was measured based on the scraping mark.

The width Wn was adjusted to 2.5 mm, by changing the contact pressure and digging amount of the intermediate transfer rollers 62 to the photoreceptors 40, etc. The contact pressure is hereinafter referred to as roller contact pressure. In the examples and comparative examples, except for example 10, the intermediate transfer roller 62 held by the holder illustrated in FIG. 4 was used. That is, the intermediate transfer roller 62 was held by the bearing 62*a* contacting the upper surface of the long hole 71. The roller contact pressure was set to 2.5 N/cm.

Figure 11:
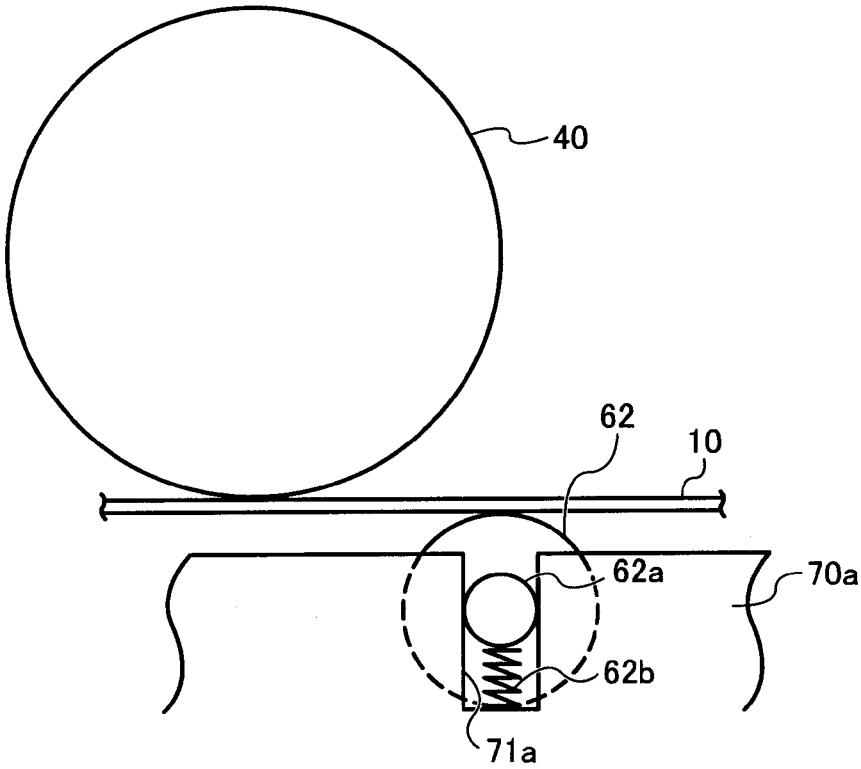
FIG. 11 is an exemplary illustration of a holder of an intermediate transfer roller.

In example 10, an intermediate transfer roller 62 held by a holder illustrated in FIG. 11 was used. The holder is provided on a frame 70*a* and includes a bearing 62*a*, springs 62*b*, and long holes 71*a*. An upper side of the frame 70*a* is open. In example 10, the intermediate transfer rollers 62 is configured to dig in the intermediate transfer belt 10 to an amount of 0.5 mm.

A contact position of the intermediate transfer roller 62 with the intermediate transfer belt 10 is shown by a value of the distance D, and hereinafter referred to as a roller contact position. The roller contact position value is positive when the contact position is downstream of the center of the photoreceptor 40, and is negative when the contact position is upstream of the center of the photoreceptor 40, in the belt moving direction.

Further, in the examples and comparative examples, intermediate transfer bias conditions was set so that a transfer rate of 93% was obtained. That is, the transfer rate was repeatedly measured with different amounts of transfer current. Based on the result, the amount of transfer current was determined.

The transfer rate is obtained as follows. Firstly, a plurality of single color images having substantially the same shape are formed on the intermediate transfer belt 10 in line along a moving direction of the intermediate transfer belt 10. The larger the images are, the higher the measurement accuracy is. However, it is necessary to change the shape depending on the diameter of the photoreceptor 40. The power is turned off when the first image is transferred onto the intermediate transfer belt 10 and the last image is formed on the photoreceptor 40. The photoreceptor 40 and the transfer unit 11 are detached from the image forming apparatus 100. The toner on the photoreceptor 40 and the intermediate transfer belt 10 is vacuumed via a filter and the amounts thereof are measured, respectively. The transfer rate is calculated by the following formula 4, $$Bt/Kt \times 100$$

wherein Bt is the amount of toner on the intermediate transfer belt 10 and Kt is the amount of toner on the photoreceptor 40.

The examples and the comparative examples were evaluated for a reverse transfer rate, a toner scattering level during transferring, a transfer property of a filled-in area, a fixing property, and a discharge image level. The evaluation results are shown in tables 1 to 4.

TABLE 1

| | Comparative example | | | Example | | |
|---|---|---|---|---|---|---|
| | 1 | 2 | 3 | 1 | 2 | 3 |
| Toner | B | E | A | A | D | C |
| Wd (mm) | 100 | 100 | 100 | 100 | 100 | 100 |
| Wn (mm) | 2.5 | 2.5 | 2.5 | 2.5 | 2.5 | 2.5 |
| Fixing temperature (° C.) | 150 | 140 | 140 | 140 | 140 | 140 |
| Roller contact position (mm) | 2.2 | 2.2 | 2.2 | 2.7 | 2.7 | 2.7 |
| Roller contact pressure (N/cm) | 2.5 | 2.5 | 2.5 | 2.5 | 2.5 | 2.5 |
| Intermediate transfer belt No. | 10a | 10a | 10a | 10a | 10a | 10a |
| Reverse transfer rate (%) | 2.8 | 3.2 | 6.8 | 3.8 | 4.0 | 4.5 |
| Toner scattering level | Good | Good | Good | Good | Good | Good |
| Fixing property 10° C. 15% RH | Bad | Average Good 150° C. | Good | Good | Good | Good |

TABLE 2

| | Example | | Comparative example | |
|---|---|---|---|---|
| | 4 | 5 | 4 | 5 |
| Toner | A | A | A | A |
| Wd (mm) | 100 | 100 | 100 | 100 |
| Wn (mm) | 2.5 | 2.5 | 2.5 | 2.5 |

TABLE 2-continued

| | Example | | Comparative example | |
|---|---|---|---|---|
| | 4 | 5 | 4 | 5 |
| Fixing temperature (° C.) | 140 | 140 | 140 | 140 |
| Roller contact position (mm) | −1 | 10.5 | 5 | 9.5 |
| Roller contact pressure (N/cm) | 2.5 | 2.5 | 2.5 | 2.5 |
| Intermediate transfer belt No. | 10a | 10a | 10a | 10a |

TABLE 2-continued

| | Example | | Comparative example | |
|---|---|---|---|---|
| | 4 | 5 | 4 | 5 |
| Reverse transfer rate (%) | 7.2 | 3.5 | 3.5 | 3.5 |
| Toner scattering level | Bad | Good | Good | Good |
| Transfer property of filled-in area | Good | Bad | Good | Average |
| Fixing property 10° C. 15% RH | Good | Good | Good | Good |

TABLE 3

| | Comparative example | | Example | | Comparative example | | Example | |
|---|---|---|---|---|---|---|---|---|
| Toner | A | A | A | A | A | A | A | A |
| Wd (mm) | 100 | 100 | 100 | 100 | 100 | 100 | 100 | 100 |
| Wn (mm) | 2.5 | 2.5 | 2.5 | 2.5 | 2.5 | 2.5 | 2.5 | 2.5 |
| Fixing temperature (° C.) | 140 | 140 | 140 | 140 | 140 | 140 | 140 | 140 |
| Roller contact position (mm) | 2.7 | 2.7 | 2.7 | 2.7 | 2.7 | 2.7 | 2.7 | 2.7 |
| Roller contact pressure (N/cm) | 2.5 | 2.5 | 2.5 | 2.5 | 2.5 | 2.5 | 2.5 | 2.5 |
| Intermediate transfer belt No. | 10b | 10c | 10d | 10e | 10f | 10g | 10h | 10i |
| Belt layer thickness (μm) | 82 | 82 | 82 | 82 | 82 | 82 | 82 | 82 |
| Belt surface resistivity | 8.8 | 9.3 | 9.7 | 11.7 | 12.2 | 12.5 | 10.5 | 11.2 |
| Belt elasticity (Mpa) | 4200 | 4200 | 4200 | 4200 | 4200 | 4200 | 4200 | 4200 |
| Surface resistivity change amount | 0.2 | 0.2 | 0.2 | 0.5 | 0.2 | 0.2 | 0.2 | 0.2 |
| Reverse transfer rate (%) | 3.5 | 3.5 | 3.5 | 3.5 | 3.5 | 3.5 | 3.5 | 3.5 |
| Toner scattering level | Average | Average | Good | Good | Good | Good | Good | Good |
| Discharge image | Good | Good | Good | Good | Bad | Bad | Good | Good |
| Fixing property 10° C. 15% RH | Good | Good | Good | Good | Good | Good | Good | Good |

TABLE 4

| | Example | | | | | Comparative example | |
|---|---|---|---|---|---|---|---|
| | 10 | 11 | 12 | 13 | 14 | 10 | 11 |
| Toner | A | A | A | A | A | A | A |
| Wd (mm) | 100 | 100 | 100 | 100 | 100 | 100 | 100 |
| Wn (mm) | 2.5 | 2.5 | 2.5 | 2.5 | 2.5 | 2.5 | 2.5 |

TABLE 4-continued

| | Example | | | | | Comparative example | |
|---|---|---|---|---|---|---|---|
| | 10 | 11 | 12 | 13 | 14 | 10 | 11 |
| Fixing temperature (° C.) | 140 | 140 | 140 | 140 | 140 | 140 | 140 |
| Roller contact position (mm) | 2.7 | 2.7 | 2.7 | 2.7 | 2.7 | 2.7 | 2.7 |
| Roller contact pressure (N/cm) | — | 2.5 | 2.5 | 2.5 | 2.5 | 2.5 | 2.75 |
| Digging amount | 0.5 | — | — | — | — | — | — |
| Intermediate transfer belt No. | 10j | 10k | 10l | 10m | 10n | 10o | 10p |
| Belt layer thickness (μm) | 82 | 52 | 61 | 83 | 98 | 105 | 130 |
| Belt surface resistivity | 11.1 | 11.1 | 11.1 | 11.1 | 11.1 | 11.1 | 11.1 |
| Belt elasticity (Mpa) | 4200 | 4200 | 4200 | 4200 | 4200 | 4200 | 4200 |
| Surface resistivity change amount | 0.2 | 0.2 | 0.2 | 0.2 | 0.2 | 0.2 | 0.2 |
| Reverse transfer rate (%) | 3.2 | 3.2 | 3.3 | 3.8 | 5.8 | 7.0 | 7.2 |
| Toner scattering level | Good | Good | Good | Good | Good | Good | Good |
| Transfer property of filled-in area | Good | Good | Good | Good | Good | Good | Good |
| Discharge image | Good | Good | Good | Good | Good | Good | Good |
| Fixing property 10° C. 15% RH | Good | Good | Good | Good | Good | Good | Good |

The rate of reverse transfer was obtained as follows. Firstly, a plurality of single color images having a substantially same shape are formed on the intermediate transfer belt 10 in line along a moving direction of the intermediate transfer belt 10. The larger the images are, the higher the measurement accuracy is. However, it is necessary to change the shape depending on the diameter of the photoreceptor 40. The power is turned off after the first image passed a first and a second process unit. The transfer unit 11 is detached from the image forming apparatus 100. The toner on the intermediate transfer belt 10 is vacuumed via a filter, and the amounts of toner after passing one transfer nip and after passing two transfer nips are measured, respectively. The reverse transfer rate is calculated by the following formula 5, $$(Bt1-Bt2)/Bt1\times 100$$

wherein Bt1 is the amount of toner after passing one transfer nip and Bt2 is the amount of toner after passing two transfer nips.

In the evaluation of transfer property of the filled-in area, a filled-in image was formed with the transfer current determined under the condition of example 1, shown in table 1. The filled-in image was checked with eyes for density unevenness. The transfer property of the filled-in area was judged as "good" when there was no density unevenness, "average" when there was slight density unevenness, and "bad" when there was unacceptable clear density unevenness.

In the evaluation of the toner scattering level, an image of black letters was formed. Toner scattering around the letters was checked with eyes through a 20-power loupe. The scattering level was judged as "good" when almost no toner scattering was observed though the 20-power loupe, "average" when some toner scattering was observed though the 20-power loupe and almost no toner scattering was observed without the loupe, and "bad" when some toner scattering was observed without the loupe.

The fixing property was evaluated based on a filled-in image after the fixing process. The fixing property was judged as "good" when a sheet having an image was folded in two and no toner fell off therefrom, "average" when the image was scratched with a nail and some toner fell off therefrom, and "bad" when the image was rubbed with a finger and some toner fell off therefrom.

Figure 12:
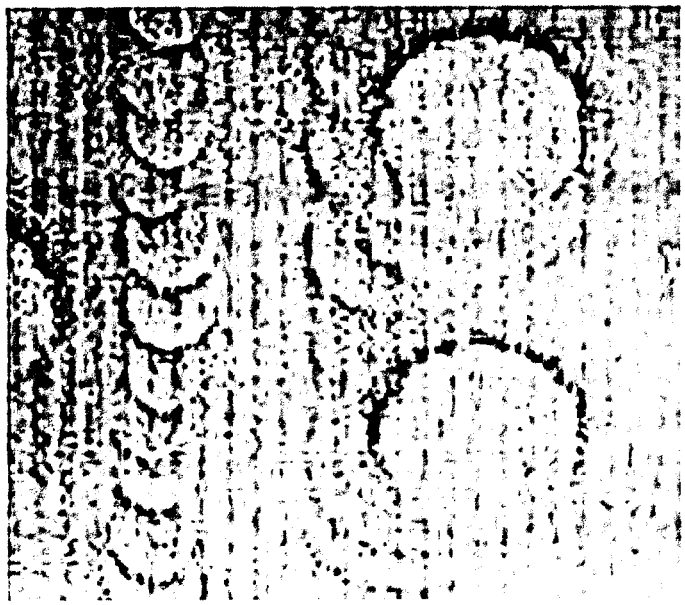
FIG. 12 is an example of a discharge image.

To evaluate a discharge image level, a half-tone image was formed across the full width of a sheet and was continuously printed for 50 sheets. The half-tone images were checked for a discharge image. The discharge image is a defect that a circle-like pattern occurs in a half-tone or filled-in image due to discharge phenomenon as illustrated in FIG. 12. The shape of the discharge image varies depending on discharge polarity, etc. The discharge image level was judged as "good" when there was no discharge image, "average" when discharge images were observed on 5 sheets or less, "bad" when discharge images were observed on 6 sheets or more.

As shown in table 1, comparative example 1 used the toner B having an additive burial rate of 30% and had a "bad" level of fixing property, even if the fixing temperature was raised to 150° C. To the contrary, in comparative example 3 and examples 1 to 3 using the toner having additive burial rate of 42% or more, the fixing property was good even if the fixing temperature was as low as 140° C.

In comparative example 3, the roller contact position, which is equivalent to the value of the distance between the centers of the intermediate transfer roller 62 and the photoreceptor 40 in the belt moving direction, was 2.2 mm. In examples 1 to 3, the value of the roller contact position was 2.7 mm. The reverse transfer rate in comparative example 3 was 6.8, which was worse than the reverse transfer rate in examples 1 to 3.

As illustrated in FIG. 10B, the intermediate transfer nip is formed when the intermediate transfer roller 62 pressed the intermediate transfer belt 10 to be wound around the photoreceptor 40. Therefore, most of the intermediate transfer nip is located upstream of the center of the photoreceptor 40 in the belt moving direction. In comparative example 3, the distance between the centers of the intermediate transfer roller 62 and the photoreceptor 40 was 2.2 mm and was smaller than the intermediate transfer nip having a width of 2.5 mm. That is, the intermediate transfer nip was formed by the photoreceptor 40 and the intermediate transfer roller 62 that sandwiched the intermediate transfer belt 10*a*. Comparative example 3 did not satisfy the relationship between the intermediate transfer roller 62, photoreceptor 40, and the intermediate transfer belt 10*a* shown by formula 2, $$L>(A/2)+(B/2)+C.$$

To the contrary, in examples 1 to 3, the distance between the centers of the intermediate transfer roller 62 and the photoreceptor 40 was 2.7 mm and was larger than the intermediate transfer nip having a width of 2.5 mm. In examples 1 to 3, the positional relationship shown by formula 2 was satisfied and the intermediate transfer roller 62 did not contact the photoreceptor 40 via the intermediate transfer belt 10*a*.

The nip pressure was higher in comparative example 3 than the nip pressure in examples 1 to 3, because the intermediate transfer roller 62 and the photoreceptor 40 sandwiched the intermediate transfer belt 10*a* to the intermediate transfer nip in comparative example 3. The toner having an additive burial rate of 40% or more has an increased agglomerating property. When the toner having an additive burial rate of 40% or more is used in comparative example 3, much toner on the intermediate transfer belt 10*a* agglomerates at the intermediate transfer nip and the transfer property was degraded. Therefore, a higher voltage was applied to the intermediate transfer roller 62 to obtain a transfer rate of 93% or more. When a higher voltage was applied to the intermediate transfer roller 62, the toner on the intermediate transfer belt 10*a* is reversely charged while passing though a plurality of intermediate transfer nips. Therefore, more toner is likely to be transferred from the intermediate transfer belt 10*a* onto the photoreceptor 40. That is the reason the reverse transfer rate was higher in comparative example 3 than in examples 1 to 3.

From table 1, it is suggested that a better fixing property at a lower temperature is available and transfer failure is reduced when the relation shown by formula 2 is satisfied and the toner having the additive burial rate of 40% or more is used.

In comparative example 4, the intermediate transfer roller 62 was placed upstream of the center of the photoreceptor 40 by 1 mm. Therefore, voltage at an entrance of the intermediate transfer nip was higher and an abnormal discharge phenomenon occurred. As a result, the toner scattering level on the image was bad, as shown in table 2.

In comparative example 5, the value of the roller contact position was 10.5 mm, which was larger than one-tenth of the distance between the photoreceptors 40 (Wd), and the transfer property of the filled-in area was bad. It seemed that the leak current flowing toward the downstream intermediate transfer nip in the belt moving direction increased because the distance between intermediate transfer roller 62 and the center of the photoreceptor 40 was larger than 10 mm (Wd/10). As a result, an optimum transfer condition was not obtained and the transfer property of the filled-in area was degraded. To the contrary, in examples 4 and 5, the distance between intermediate transfer roller 62 and the center of the photoreceptor 40 was not greater than one-tenth of the distance between the photoreceptors 40 (Wd). Therefore, the leak current flowing toward the downstream intermediate transfer nip in the belt moving direction was reduced and a better transfer property of the filled-in area was obtained.

As shown in table 3, the intermediate transfer belts 10*b* and 10*c* having surface resistivity under 9.5 log Ω/square were used in comparative examples 6 and 7. Because each of the intermediate transfer belts 10*b* and 10*c* had a high potential at the entrance of the intermediate transfer nip, toner was transferred in the gap located at the entrance of the intermediate transfer nip. Therefore, the toner scattering level was not good in each of comparative examples 6 and 7.

The intermediate transfer belts 10*f* and log having surface resistivity over 21 log Ω/square were used in comparative examples 8 and 9. A higher voltage was applied to the intermediate transfer roller 62 in each of comparative examples 8 and 9 to obtain a transfer rate of 93% because the surface resistivity of the intermediate transfer belts 10*f* or 10*g* was high. Therefore, the electric potential at the exit of the intermediate transfer nip increased, which invited an abnormal discharge phenomenon in the gap at the exit of the intermediate transfer nip. As a result, the toner image on the intermediate transfer belt 10*f* or log was disturbed due to the abnormal discharge phenomenon and the discharge image level was bad in each of the comparative examples 8 and 9.

To the contrary, satisfactory image quality was obtained with little toner scattering and discharge image in examples 6 and 7 in which the intermediate transfer belts 10*d* and 10*e* having surface resistivity within a range from 9.5 to 12 log Ω/square were used. However, in example 7, the discharge image level was degraded over time. It seemed that the surface resistivity exceeded 12 log Ω/square over time because the surface resistivity change amount was 0.5 in example 7. Accordingly, speed of the charge removal became slower and the amount of remaining potential increased. As a result, discharge phenomenon occurred and the discharge image level was degraded over time.

As shown in table 4, the transfer property of the filled-in area was bad in comparative examples 10 and 11 using the intermediate transfer belts 10*o* and 10*p* whose thicknesses were over 100 μm. It seemed that the pressure to the toner at the intermediate transfer nip increased because the intermediate transfer belts 10*o* and 10*p* were thicker. That is, the toner A having an additive burial rate of 40% or more agglomerated when the pressure to the toner A increased because of its increased agglomeration property. Therefore, the transfer property of the filled-in area was degraded.

Further, the reverse transfer rate was over 7.0% in comparative examples 10 and 11, which was higher than other examples. The reason may be as follows. A higher voltage was applied to the intermediate transfer roller 62, to obtain a transfer rate of 93% in each of comparative examples 10 and 11, because the reverse transfer rate was bad. However, when the voltage was increased, the toner on the intermediate transfer belts 10*o* and 10*p* were reversely charged while passing through a plurality of intermediate transfer nips. Therefore, more toner was reversely transferred from the intermediate transfer belt 10*o* or 10*p* to the photoreceptor 40, which resulted in the reverse transfer rate of 7.0% or more.

To the contrary, the transfer rate of the filled-in area was good in examples 10 to 14 using the intermediate transfer belts 10*j* to 10*n* whose thicknesses were under 100 μm. Therefore, the reverse transfer rate was reduced and satisfactory image quality was obtained because a high transfer bias was not necessary.

Further, the fixing property at a lower temperature and image quality were good in example 10 in which the intermediate transfer roller 62 was kept in contact with the back surface of the intermediate transfer belt 10*j* with the force of the spring, as illustrated in FIG. 11.

As described above, the image forming apparatus according to exemplary embodiments may melt the toner at a lower temperature by using the toner having an additive burial rate of 40% or more. Therefore, energy required in the fixing process may be reduced, which leads to power-saving by the image forming apparatus.

Further, the intermediate transfer roller 62, as a bias applying roller, is placed on a plane perpendicular to an axis direction of the intermediate transfer belt 10, as an endless belt, along a vertical plane so that the following relation is satisfied, $$L>(A/2)+(B/2)+C$$

where L is a distance between axis centers of the photoreceptor 40, as an image carrier, and the intermediate transfer roller 62, A is a diameter of the photoreceptor 40, B is a diameter of the intermediate transfer roller 62, and C is a thickness of the intermediate transfer belt 10. Therefore, the intermediate transfer roller 62 is placed at a position not contacting the photoreceptor 40 via the intermediate transfer belt 10. With this configuration, the intermediate transfer nip is formed where the intermediate transfer belt 10 winds around the photoreceptor 40. The nip pressure at the above intermediate transfer nip is lower compared with the nip pressure at the intermediate transfer nip formed by the photoreceptor 40 and the intermediate transfer roller 62 that sandwich the intermediate transfer belt 10. Therefore, toner agglomeration by the nip pressure is prevented or reduced, and a satisfactory transfer property may be available even if the toner has an additive burial rate of 40 percent or greater and an increased agglomeration property.

Further, in an exemplary embodiment, the intermediate transfer roller 62 was placed downstream of the photoreceptor 40 in the belt moving direction. Therefore, the voltage at the entrance of the intermediate transfer nip does not excessively rise, and an abnormal discharge phenomenon at the gap at the entrance of the intermediate transfer nip may be prevented or reduced. As a result, the toner on the photoreceptor 40 may be prevented from being transferred onto the intermediate transfer belt 10 in the gap at the entrance of the intermediate transfer nip, which reduces the number of defective images having toner scattering.

Further, in the image forming apparatus according to an exemplary embodiment, the nip pressure is lowered to enhance the transfer property of the toner that easily agglomerates. Therefore, less electric charge is injected into the toner, compared with an image forming apparatus using an increased transfer bias to enhance the transfer property of such a toner. Therefore, the toner may be prevented from being reversely charged, even if the toner on the intermediate transfer belt passes through a plurality of transfer nips, like in a tandem image forming apparatus having a plurality of photoreceptors that contact a front surface of an intermediate transfer belt in order to form transfer nips. Thus, satisfactory image quality with reduced reverse transfer may be available.

Further, in an exemplary embodiment, the intermediate transfer roller is placed at a position satisfying the positional relation, D<(Wd/10), where D is a distance between the axis centers of the photoreceptor and the corresponding intermediate transfer roller in the belt moving direction and Wd is a distance between photoreceptors. Therefore, the leak current flowing from the target intermediate transfer roller toward the downstream intermediate transfer nip in the belt moving direction may be reduced to under one-tenth. As a result, the transfer condition may be maintained at an optimum level at the downstream transfer nip, without being affected by the leak current, and a satisfactory transfer property may be maintained.

Further, in an exemplary embodiment, the potential at the entrance of the intermediate transfer nip does not excessively increase, because the intermediate transfer belt has a surface resistivity within a range from 9.5 log Ω/square to 12 log Ω/square. Further, a high amount of voltage is not required for the intermediate transfer roller to obtain a satisfactory transfer property. As a result, toner scattering and discharge image on output sheets may be reduced.

Further, the surface resistivity change amount of the intermediate transfer belt is 0.5 log Ω/square or less, in a continuous measurement from 10 seconds to 5 hours after the start of energization in an exemplary embodiment. Therefore, the tolerance range may be widened to have an upper limit of surface resistivity tolerance of 11.5 log Ω/square or more. Therefore, the manufacturing cost of the intermediate transfer belt may be reduced.

Further, the image forming apparatus according to an exemplary embodiment is provided with a holder as a positioner for locating the intermediate transfer roller at a predetermined or desirable position in a vertical direction. The holder includes a long hole provided on the frame of the transfer unit, a bearing, and a spring. The bearing rotatably holds the intermediate transfer roller and moves up and down in contact with the frame. The spring pushes the bearing toward the photoreceptor. The bearing contacts an upper surface of the long hole by the force of the spring so that the position of the intermediate transfer roller is determined.

The contact pressure of the intermediate transfer roller to the intermediate transfer belt may be controlled to a predetermined or desirable value, because the intermediate transfer roller is positioned at a predetermined or desirable position. If the intermediate transfer roller is kept in contact with the intermediate transfer belt with only the force of the spring, the contact pressure to the intermediate transfer belt may vary depending on the variability of the spring. However, fluctuation in pressure and width of the intermediate transfer nip may be reduced according to an exemplary embodiment.

Further, a single-layered belt including polyimide or polyamide-imide, which excels in mechanical strength and resistivity stability, is used as the intermediate transfer belt. Therefore, the intermediate transfer belt may have prolonged durability. Because the thickness of the intermediate transfer belt may be reduced to 100 μm or less, the pressure to the toner image at the intermediate transfer nip may be reduced and, accordingly, toner agglomeration may be prevented or reduced. Further, when the intermediate transfer belt has a thickness of 40 μm or more, expansion of the intermediate transfer belt during image formation may be prevented or reduced and displacement of color may be prevented or reduced.

Further, the fixing temperature may be lowered because a polyester resin, which excels in the fixing property at a lower temperature, is used as a binder resin of the toner. Therefore, energy-saving of the image forming apparatus may be available.

Figure 13:
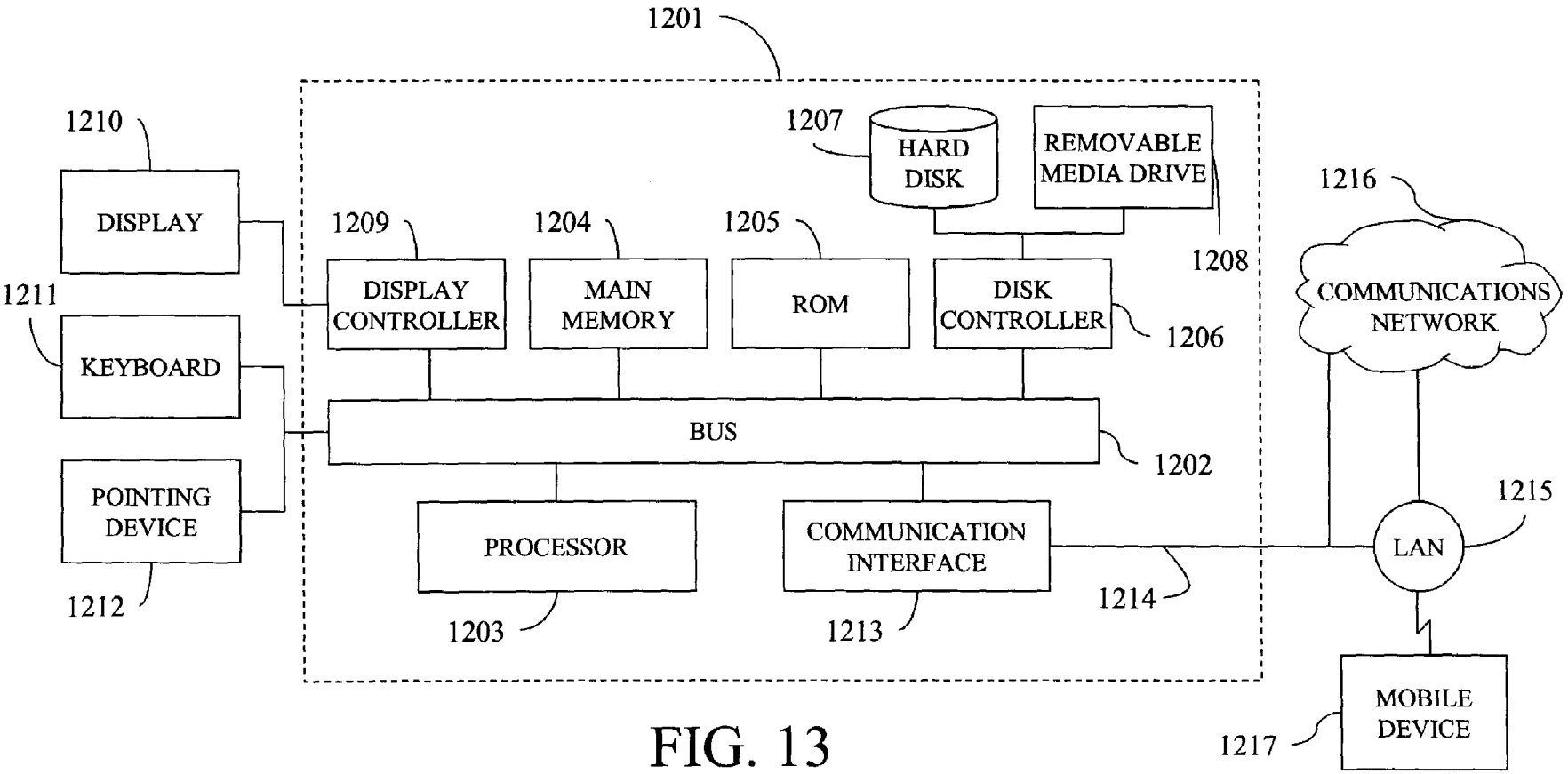
FIG. 13 is an exemplary computer system upon which an embodiment of the present invention may be implemented.

FIG. 13 illustrates a computer system 1201 upon which an embodiment of the present invention may be implemented. The computer system 1201 includes a bus 1202 or other communication mechanism for communicating information, and a processor 1203 coupled with the bus 1202 for processing the information. The computer system 1201 also includes a main memory 1204, such as a random access memory (RAM) or other dynamic storage device (e.g., dynamic RAM (DRAM), static RAM (SRAM), and synchronous DRAM (SDRAM)), coupled to the bus 1202 for storing information and instructions to be executed by processor 1203. In addition, the main memory 1204 may be used for storing temporary variables or other intermediate information during the execution of instructions by the processor 1203. The computer system 1201 further includes a read only memory (ROM) 1205 or other static storage device (e.g., programmable ROM (PROM), erasable PROM (EPROM), and electrically erasable PROM (EEPROM)) coupled to the bus 1202 for storing static information and instructions for the processor 1203.

The computer system 1201 also includes a disk controller 1206 coupled to the bus 1202 to control one or more storage devices for storing information and instructions, such as a magnetic hard disk 1207, and a removable media drive 1208 (e.g., floppy disk drive, read-only compact disc drive, read/write compact disc drive, compact disc jukebox, tape drive, and removable magneto-optical drive). The storage devices may be added to the computer system 1201 using an appropriate device interface (e.g., small computer system interface (SCSI), integrated device electronics (IDE), enhanced-IDE (E-IDE), direct memory access (DMA), or ultra-DMA).

The computer system 1201 may also include special purpose logic devices (e.g., application specific integrated circuits (ASICs)) or configurable logic devices (e.g., simple programmable logic devices (SPLDs), complex programmable logic devices (CPLDs), and field programmable gate arrays (FPGAs)).

The computer system 1201 may also include a display controller 1209 coupled to the bus 1202 to control a display 1210, such as a cathode ray tube (CRT), for displaying information to a computer user. The computer system includes input devices, such as a keyboard 1211 and a pointing device 1212, for interacting with a computer user and providing information to the processor 1203. The pointing device 1212, for example, may be a mouse, a trackball, or a pointing stick for communicating direction information and command selections to the processor 1203 and for controlling cursor movement on the display 1210. In addition, a printer may provide printed listings of data stored and/or generated by the computer system 1201.

The computer system 1201 performs a portion or all of the processing steps of the invention in response to the processor 1203 executing one or more sequences of one or more instructions contained in a memory, such as the main memory 1204. Such instructions may be read into the main memory 1204 from another computer readable medium, such as a hard disk 1207 or a removable media drive 1208. One or more processors in a multi-processing arrangement may also be employed to execute the sequences of instructions contained in main memory 1204. In alternative embodiments, hard-wired circuitry may be used in place of or in combination with software instructions. Thus, embodiments are not limited to any specific combination of hardware circuitry and software.

As stated above, the computer system 1201 includes at least one computer readable medium or memory for holding instructions programmed according to the teachings of the invention and for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SDRAM, or any other magnetic medium, compact discs (e.g., CD-ROM), or any other optical medium, punch cards, paper tape, or other physical medium with patterns of holes, a carrier wave (described below), or any other medium from which a computer can read.

Stored on any one or on a combination of computer readable media, the present invention includes software for controlling the computer system 1201, for driving a device or devices for implementing the invention, and for enabling the computer system 1201 to interact with a human user (e.g., print production personnel). Such software may include, but is not limited to, device drivers, operating systems, development tools, and applications software. Such computer readable media further includes the computer program product of the present invention for performing all or a portion (if processing is distributed) of the processing performed in implementing the invention.

The computer code devices of the present invention may be any interpretable or executable code mechanism, including but not limited to scripts, interpretable programs, dynamic link libraries (DLLs), Java classes, and computer executable programs. Moreover, parts of the processing of the present invention may be distributed for better performance, reliability, and/or cost.

The term "computer readable medium" as used herein refers to any medium that participates in providing instructions to the processor 1203 for execution. A computer readable medium may take many forms, including but not limited to, non-volatile media, volatile media, and transmission media. Non-volatile media includes, for example, optical, magnetic disks, and magneto-optical disks, such as the hard disk 1207 or the removable media drive 1208. Volatile media includes dynamic memory, such as the main memory 1204. Transmission media includes coaxial cables, copper wire and fiber optics, including the wires that make up the bus 1202. Transmission media may also take the form of acoustic or light waves, such as those generated during radio wave and infrared data communications.

Various forms of computer readable media may be involved in carrying out one or more sequences of one or more instructions to processor 1203 for execution. For example, the instructions may initially be carried on a magnetic disk of a remote computer. The remote computer can load the instructions for implementing all or a portion of the present invention remotely into a dynamic memory and send the instructions over a telephone line using a modem. A modem local to the computer system 1201 may receive the data on the telephone line and use an infrared transmitter to convert the data to an infrared signal. An infrared detector coupled to the bus 1202 can receive the data carried in the infrared signal and place the data on the bus 1202. The bus 1202 carries the data to the main memory 1204, from which the processor 1203 retrieves and executes the instructions. The instructions received by the main memory 1204 may optionally be stored on storage device 1207 or 1208 either before or after execution by processor 1203.

The computer system 1201 also includes a communication interface 1213 coupled to the bus 1202. The communication interface 1213 provides a two-way data communication coupling to a network link 1214 that is connected to, for example, a local area network (LAN) 1215, or to another communications network 1216 such as the Internet. For example, the communication interface 1213 may be a network interface card to attach to any packet switched LAN. As another example, the communication interface 1213 may be an asymmetrical digital subscriber line (ADSL) card, an integrated services digital network (ISDN) card or a modem to provide a data communication connection to a corresponding type of communications line. Wireless links may also be implemented. In any such implementation, the communication interface 1213 sends and receives electrical, electromagnetic or optical signals that carry digital data streams representing various types of information.

The network link 1214 typically provides data communication through one or more networks to other data devices. For example, the network link 1214 may provide a connection to another computer through a local network 1215 (e.g., a LAN) or through equipment operated by a service provider, which provides communication services through a communications network 1216. The local network 1214 and the communications network 1216 use, for example, electrical, electromagnetic, or optical signals that carry digital data streams, and the associated physical layer (e.g., CAT 5 cable, coaxial cable, optical fiber, etc). The signals through the various networks and the signals on the network link 1214 and through the communication interface 1213, which carry the digital data to and from the computer system 1201 maybe implemented in baseband signals, or carrier wave based signals. The baseband signals convey the digital data as unmodulated electrical pulses that are descriptive of a stream of digital data bits, where the term "bits" is to be construed broadly to mean symbol, where each symbol conveys at least one or more information bits. The digital data may also be used to modulate a carrier wave, such as with amplitude, phase and/or frequency shift keyed signals that are propagated over a conductive media, or transmitted as electromagnetic waves through a propagation medium. Thus, the digital data may be sent as unmodulated base band data through a "wired" communication channel and/or sent within a predetermined frequency band, different than baseband, by modulating a carrier wave. The computer system 1201 can transmit and receive data, including program code, through the network(s) 1215 and 1216, the network link 1214 and the communication interface 1213. Moreover, the network link 1214 may provide a connection through a LAN 1215 to a mobile device 1217 such as a personal digital assistant (PDA) laptop computer, or cellular telephone.

This application claims priority and contains subject matter related to Japanese Patent Application No. JP2006-136894 filed on May 16, 2006 in the Japan Patent Office, the entire contents of which are hereby incorporated by reference.

Having now fully described exemplary embodiments of the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

a plurality of image carriers including an image carrier configured to bear a toner image;

an endless belt configured to sequentially contact a front surface thereof with the plurality of image carriers to form respective transfer nips;

a plurality of bias applying rollers provided at positions corresponding to the respective image carriers, including a bias applying roller configured to apply a transfer bias to a back surface of the endless belt to transfer the toner image from the image carrier to the endless belt, wherein the toner image is formed of a toner including an external additive at an additive burial rate of not less than 40 percent and a mother particle including a binder resin and a colorant, wherein at least one of the bias applying rollers is located so as to satisfy the following relationship $$L>(A/2)+(B/2)+C$$

where A is a diameter of the image carrier, B is a diameter of the bias applying roller, C is a thickness of the endless belt, and L is a distance between axis centers of the image carrier and the bias applying roller on a virtual plane perpendicular to an axis direction of the image carrier, and wherein each of the bias applying rollers is placed so as to satisfying the following relationship $$D<(Wd/10)$$

where D is a distance between the axis centers of each of the image carrier and the corresponding bias applying roller in a moving direction of the endless belt and Wd is a distance between centers of the image carriers.

2. The image forming apparatus according to claim 1, wherein the bias applying roller is placed downstream of the image carrier in a moving direction of the endless belt.

3. The image forming apparatus according to claim 1, wherein the endless belt has a surface resistivity within a range from 9.5 log Ω/square to 12.0 log Ω/square.

4. The image forming apparatus according to claim 3, wherein the endless belt has an amount of surface resistivity change not greater than 0.5 log Ω/square, from 10 seconds to five hours after the endless belt starts to receive a voltage of 500 V.

5. The image forming apparatus according to claim 1, further comprising a positioner configured to position the bias applying roller to contact the endless belt.

6. The image forming apparatus according to claim 1, wherein the binder resin is a polyester resin.

7. An image forming apparatus, comprising:

an image carrier configured to bear a toner image;

an endless belt configured to contact a front surface thereof with the image carrier to form a transfer nip; and a bias applying roller configured to apply a transfer bias to a back surface of the endless belt to transfer the toner image from the image carrier to the endless belt, wherein the toner image is formed of a toner including an external additive at an additive burial rate of not less than 40 percent and a mother particle including a binder resin and a colorant, wherein the bias applying roller is located so as to satisfy the following relationship $$L>(A/2)+(B/2)+C$$

where A is a diameter of the image carrier, B is a diameter of the bias applying roller, C is a thickness of the endless belt, and L is a distance between axis centers of the image carrier and the bias applying roller on a virtual plane perpendicular to an axis direction of the image carrier, wherein the endless belt is a single-layered belt including polyimide or polyamide-imide resin, and wherein the endless belt has a thickness within a range from 40 μm to 100 μm.

8. An image forming method, comprising;

applying a transfer bias with a plurality of bias applying rollers to a back surface of an endless belt whose front surface sequentially contacts a plurality of image carriers to form respective transfer nips, to transfer a toner image from the image carriers to the endless belt;

forming a toner image using a toner including an external additive at an additive burial rate of not less than 40 percent and a mother particle including a binder resin and a colorant; and locating at least one of the bias applying rollers so as to satisfy the following relationship $$L>(A/2)+(B/2)+C$$

where A is a diameter of the image carrier, B is a diameter of the bias applying roller, C is a thickness of the endless belt, and L is a distance between axis centers of the image carrier and the bias applying roller on a virtual plane perpendicular to an axis direction of the image carrier, and wherein each of the bias applying rollers is placed so as to satisfying the following relationship $$D<(Wd/10)$$

where D is a distance between the axis centers of each of the image carrier and the corresponding bias applying roller in a moving direction of the endless belt and Wd is a distance between centers of the image carriers.

9. The image forming method according to claim 8, wherein the applying includes contacting the image carriers with the endless belt, the endless belt being a single-layered belt including polyimide or polyamide-imide resin with a thickness within a range from 40 μm to 100 μm.

* * * * *